US008186239B2

(12) United States Patent
Wakitani et al.

(10) Patent No.: US 8,186,239 B2
(45) Date of Patent: May 29, 2012

(54) ORIGIN RESTORATION MECHANISM FOR OPERATING MEMBER AND MULTI-DIRECTION INPUT APPARATUS USING THE SAME

(75) Inventors: Noboru Wakitani, Kyoto (JP); Junji Takamoto, Kyoto (JP); Daisuke Kumazaki, Kyoto (JP); Katsunori Kondo, Yao (JP)

(73) Assignees: Nintendo Co., Ltd., Kyoto (JP); Hosiden Corporation, Osaka (JP)

( * ) Notice: Subject to any disclaimer, the term of this patent is extended or adjusted under 35 U.S.C. 154(b) by 1420 days.

(21) Appl. No.: 11/485,419

(22) Filed: Jul. 13, 2006

(65) Prior Publication Data

US 2007/0042303 A1 Feb. 22, 2007

(30) Foreign Application Priority Data

Aug. 5, 2005 (JP) ..... 2005-227949

(51) Int. Cl.

| | |
|---|---|
| ***G05G 9/047*** | (2006.01) |
| ***G05G 1/00*** | (2006.01) |
| ***H01H 13/70*** | (2006.01) |
| ***H01H 25/00*** | (2006.01) |
| ***H01H 25/04*** | (2006.01) |

(52) U.S. Cl. ..... 74/471 XY; 74/161; 74/548; 74/555; 200/5 R; 200/6 A; 345/156; 345/161

(58) Field of Classification Search ..... 74/471 XY, 74/548, 555, 161; 345/161, 156, 157; 200/5 R, 200/6 A See application file for complete search history.

(56) References Cited

U.S. PATENT DOCUMENTS

| | | | | | |
|---|---|---|---|---|---|
| 1,960,371 | A | * | 5/1934 | Coffing | 254/353 |
| 2,444,457 | A | * | 7/1948 | Graham et al. | 359/812 |
| 2,479,560 | A | * | 8/1949 | Eaton | 279/33 |
| 2,513,858 | A | * | 7/1950 | Fuehrer | 279/33 |
| 2,980,434 | A | * | 4/1961 | Hoffman | 279/106 |
| 2,984,720 | A | * | 5/1961 | Fisher | 335/161 |
| 3,016,245 | A | * | 1/1962 | Von Zelewsky | 279/106 |
| 3,091,130 | A | * | 5/1963 | Payerle et al. | 74/471 R |
| 3,270,592 | A | * | 9/1966 | Behnke | 82/117 |
| 3,413,667 | A | * | 12/1968 | Behnke | 470/66 |
| 3,550,466 | A | * | 12/1970 | Ham | 74/471 XY |
| 3,707,093 | A | * | 12/1972 | Worden | 74/471 XY |
| 4,161,726 | A | * | 7/1979 | Burson et al. | 341/9 |
| 4,584,443 | A | * | 4/1986 | Yaeger | 200/6 A |

(Continued)

FOREIGN PATENT DOCUMENTS

JP 9-44296 2/1997

(Continued)

*Primary Examiner* — Vinh T. Luong

(74) *Attorney, Agent, or Firm* — Nixon & Vanderhye P.C.

(57) ABSTRACT

An origin restoration mechanism includes a base unit arranged in X-Y directions to cross the axis of an operating member body of an operating member, a link mechanism arranged on the upper surface of the base unit and a pair of urging devices for urging a rotary unit of the link mechanism. The link mechanism includes the rotary unit arranged around the axis of the operating member body and our movable members arranged equidistantly around the axis of the operating member body inside the rotary unit on the surface of the base unit and having rear ends coupled rotatably to the rotary unit. Via urging forces, the portions inside of the distal end of the four movable members come into contact with different portions, respectively, of the outer surface of the operating member body located at the original position C, to hold the operating member body.

6 Claims, 15 Drawing Sheets

U.S. PATENT DOCUMENTS

| | | | | |
|---|---|---|---|---|
| 4,590,339 | A * | 5/1986 | Scott-Jackson et al. | 200/6 A |
| 4,926,011 | A * | 5/1990 | Saito | 200/6 A |
| 5,074,176 | A * | 12/1991 | Redman et al. | 82/165 |
| 5,087,904 | A * | 2/1992 | DeVolpi | 338/128 |
| 5,228,356 | A * | 7/1993 | Chuang | 74/471 XY |
| 5,436,640 | A * | 7/1995 | Reeves | 345/161 |
| 5,459,292 | A * | 10/1995 | Nagano et al. | 200/5 R |
| 6,040,758 | A * | 3/2000 | Sedor et al. | 338/197 |
| 6,667,733 | B2 * | 12/2003 | Miyoshi | 345/156 |
| 6,753,848 | B2 * | 6/2004 | Toshiharu | 345/157 |
| 6,874,790 | B2 * | 4/2005 | Sundkvist | 279/35 |
| 6,997,656 | B2 * | 2/2006 | Bengston et al. | 409/225 |
| 7,308,971 | B2 * | 12/2007 | Liebetreu et al. | 187/216 |
| 7,636,081 | B2 * | 12/2009 | Takamoto et al. | 345/161 |
| 2001/0030113 | A1 * | 10/2001 | Toshiharu | 200/5 R |
| 2002/0139801 | A1 * | 10/2002 | Hagano et al. | 220/304 |

FOREIGN PATENT DOCUMENTS

| | | |
|---|---|---|
| JP | 2001-255995 | 9/2001 |

* cited by examiner

521

522

Diagram showing the state in which the operating member is located at original position Diagram showing the state in which the operating member is moved right downward Diagram showing the state in which the operating member is displaced in maximum right downward

ORIGIN RESTORATION MECHANISM FOR OPERATING MEMBER AND MULTI-DIRECTION INPUT APPARATUS USING THE SAME

This application is based upon and claims the benefit of priority from the prior Japanese Patent Application No. 2005-227949 filed on Aug. 5, 2005 under 35 U.S.C. §119, and the entire contents of which are incorporated herein by reference.

BACKGROUND

Example embodiments of the present invention relate to an origin restoration mechanism for an operating member whereby the operating member moved in the direction away from a predetermined original position is restored to the original position automatically and a multi-direction input apparatus using the origin restoration mechanism.

A conventional multi-direction input apparatus of this type includes an operating member with an end operably projected from the opening of a ceiling plate portion of a case body and adapted to move in X-Y directions from the original position constituting the center of the opening in accordance with the operation, first and second mobile units having first and second slots extending in X and Y directions into which the other end of the operating member is inserted, which mobile units are movable in X and Y directions in accordance with the movement of the operating member, first and second signal output means for outputting first and second signals in accordance with the movement of the first and second mobile units, respectively, and an origin restoration mechanism for restoring the moved operating member to the original position.

The origin restoration mechanism described above is configured of first and second coil springs accommodated along X and Y directions in the first and second accommodating portions formed at the rear end portions of the first and second mobile units, respectively, and a pair of first and second stoppers formed as protrusions in spaced relation to each other along X and Y directions at positions adapted to contact the ends of the first and second coil springs of the case body (refer to Japanese Unexamined Patent Publication No. 2001-255995).

Specifically, with the movement of the first and second mobile units in X and Y directions by the activation of the operating member, the first and second coil springs are compressed between one of the wall surfaces along the length of the first and second accommodating portions and the other one of the first and second stoppers. With the subsequent release of the operating member, the first and second mobile units are moved by restoration in X and Y directions by the urging force of the first and second coil springs, so that the operating member is restored to the original position.

In the origin restoration mechanism described above, however, the operating member is simply restored to the original position by urging the first and second mobile units in the direction opposite to the movement by the first and second coil springs, and therefore the operating member sometimes exceeds the original position due to the urging force.

SUMMARY

Example embodiments of the present invention have been developed in view of the situation described above and as aspect thereof is to improve the accuracy of restoration of the operating member to the original position by suppressing the operating member from exceeding the original position during the origin restoration process.

In order to solve this problem, according to a first aspect of example embodiments of the invention, there is provided an operating member origin restoration mechanism operable to move in a direction away from a predetermined original position, wherein the operating member is urged by equal urging forces acting on each other from opposed directions facing the operating member so as to hold the operating member at the original position.

With this origin restoration mechanism, upon operating the operating member to move in a direction away from the original position against the urging force along the direction of movement, the urging force on the side in the direction of movement is increased while the urging force on the side in the direction of non-movement is decreased. Upon release of the operating member, on the other hand, the operating member is urged in the direction of restoration by the urging force on the side in the direction of movement and pushed back toward the original position. Upon restoration of the operating member to the original position, the urging force on the side in the direction of movement is balanced with the urging force on the side in the direction of non-movement, so that the operating member is held at the original position. Unlike in the prior art, therefore, the operating member is not moved beyond the original position, and the accuracy of the restoration motion of the operating member is improved.

The origin restoration mechanism may include a base unit arranged in such a manner as to cross the axis of the operating member, a link mechanism provided on a surface of the base unit and having a plurality of movable members, the movable members having the distal end portions arranged in opposed relation to each other facing the operating member, the movable members being coupled such that the distal end portions thereof are movable toward the original position, and an urging means for moving the distal end portions of the plurality of the movable members toward the original position, wherein a plurality of urging forces of the urging means exerted through the plurality of the movable members are exerted equally on the operating member and acting on each other due to abutment of the distal end portions of all the movable members against the operating member located at the original position.

With this origin restoration mechanism, upon movement of the operating member in a direction away from a predetermined original position, the distal ends of a part of the movable members located in the operative direction by the operating member among the plurality of the movable members are pushed against the urging force of the urging means and move in the direction away from the original position, while the distal end portions of the remaining movable members move in similar fashion. After that, upon release of the operating member, the distal end portions of a part of the movable members push the operating member back to the original position by the urging force of the urging means, while the distal end portions of the remaining movable members move toward the original position. Once the operating member is located at the original position, the distal end portions of all the movable members come into contact with the operating member. At the same time, a plurality of urging forces of the urging means are exerted equally on the operating member through the plurality of the movable members and act on each other, so that the operating member is held at the original position. In this way, the restoration motion of the part of the movable members and the restoration movement of the remaining movable members are interlocked with each other. Therefore, the distal end portions of all the movable members can be easily brought into contact with the operating member at the same intended timing, resulting in the advantage that the accuracy of the restoration motion of the operating member is easily improved.

As an alternative, the origin restoration mechanism may include a base unit arranged in such a manner as to cross the axis of the operating member, a plurality of movable members arranged on a surface of the base unit in opposed relation to each other facing the operating member and being movable toward the original position, and a plurality of urging means for urging the movable members toward the original position, wherein urging forces of the plurality of the urging means are exerted equally on the operating member and acting on each other due to abutment of all the movable members against the operating member located at the original position.

With this origin restoration mechanism, upon operating operating member to move in a direction away from a predetermined original position, a part of the movable members located in the operative direction among the plurality of the movable members are pushed against the urging force of a part of the urging means by the operating member and moved in a direction away from the original position, while the remaining movable members are moved in the manner following the operating member by the urging forces of the remaining movable members. After that, upon release of the operating member, a part of the movable members push the operating member back toward the original position by the urging force of a part of the urging means, while the remaining movable members are moved in the same direction against the urging forces of the remaining urging means. With the arrival of the operating member at the original position, the urging forces of the plurality of the urging means are exerted equally on the operating member through the plurality of the movable members and act on each other, so that the operating member is held at the original position. In this way, the accuracy of the restoration motion of the operating member can be improved with a simple configuration, thereby leading to the advantage of a reduced cost.

The link mechanism may include an annular rotary unit provided on the surface of the base unit rotatably around the axis of the operating member and said plurality of movable members having rear ends rotatably coupled to the rotary unit and being journaled rotatably in accordance with the rotation of the rotary unit around the axis of the operating member inside the rotary unit on the surface of the base unit. The urging means urges the rotary unit in a predetermined peripheral direction, and the urging force of the urging means causes a transverse end surface of the distal end portion of each movable member to come into contact with a different portion of the outer surface of the operating member located at the original position.

The use of the rotary unit in this way can reduce the number of the urging means. Thus, the reduced number of parts will result in a lower cost.

The base unit includes a circular hole through which the operating member is inserted, and an arcuate notch is formed on an end surface of the distal end portion of each movable member of the link mechanism. The notch assumes the same arcuate shape in plan view as the edge portion of the hole of the base unit in the case where the operating member moves to the maximum movable position.

In this case, once the operating member comes to be located at the maximum movable position, the load due to the urging forces of the urging means is exerted equally in all the operating directions on the operating member through the rotary unit and a part of the movable members in contact therewith. As a result, the rotational operation of the operating member is smoothed for an improved operation feeling.

According to a second aspect of example embodiments of the invention, there is provided an origin restoration mechanism for an operating member operable to move in a direction away from a predetermined original position, including a first action force application device for applying, to the operating member operated to move, an action force in the direction of restoration toward the original position, and a second action force application device for applying, to the operating member restored to the original position by the action force of the first action force application device, action force in the direction opposite to the restoration.

With the origin restoration mechanism for an operating member according to the second aspect, upon operating the operating member to move in a direction away from the original position, the action force is applied to the operating member by the first action force application means in the direction of restoration toward the original position. Therefore, the operating member, once released, is restored toward the original position by the action force. With the arrival of the operating member at the original position, the action force in the direction opposite to the restoration is applied to the operating member by the second action force application means. As a result, the operating member can be kept at the original position, thereby improving the accuracy of the restoration operation of the operating member.

The origin restoration mechanism may include a base unit arranged in such a manner as to cross the axis of the operating member, a first movable member in the direction of movement of the operating member on a surface of the base unit and being movable toward the original position, a second movable member arranged on the surface of the base unit in opposed relation to the first movable member with the operating member therebetween and being movable toward the original position, and a link for interlocking the first movable member with the second movable member. The first and second action force application means apply the action forces to the first and second movable members through the link thereby to bring the first and second movable members into contact with the operating member located at the original position.

With this origin restoration mechanism, upon operating the operating member to move in a direction away from the original position, against the action forces of the first and second action force application means exerted through the link, the first movable member moves in the direction away from the original position together with the operating member, while at the same time moving the second movable member in the direction away from the original position. After that, upon release of the operating member, by the action force of the first and second action force application means exerted through the link, the first movable member and the operating member are moved and restored to the original position, while at the same time the second movable member are moved toward the original position. With the restoration of the operating member to the original position, the second movable member comes into contact with the operating member, so that the first and second movable members sandwich the operating member. As a result, the operating member is held at the original position. In this way, the restoration motions of the first movable member and the restoration operation of the second movable member are interlocked with each other by the link, and therefore the first and second movable members are easily brought into contact with the operating member at the same intended timing. Thus, the accuracy of restoration of the operating member is easily improved advantageously.

As an alternative, the origin restoration mechanism may include a base unit arranged in such a manner as to cross the axis of the operating member, a first movable member arranged in the direction of movement of the operating member on a surface of the base unit and movable toward the original position, and a second movable member arranged in opposed relation to the first movable member with the operating member therebetween on the surface of the base unit and being movable toward the original position. The first and second action force application means apply the action forces to the first and second movable members thereby to bring the first and second movable members into contact with the operating member located at the original position.

With this origin restoration mechanism, upon operating the operating member to move in a direction away from the original position, the first movable member is pushed by the operating member against the action force of the first action force application means and moves in the direction away from the original position. After that, upon release of the operating member, the first movable member and the operating member are moved for restoration toward the original position by the action force of the first action force application means. Once the operating member is restored to the original position, the second movable member is moved in the direction opposite to the restoration by the action force of the second action force application means and comes into contact with the operating member. As a result, the first and second movable members sandwich the operating member in contact therewith and hold the operating member at the original position. With this simple configuration, the accuracy of the restoration operation of the operating member can be improved and the cost can be advantageously reduced.

According to a third aspect of example embodiments of the invention, there is provided an origin restoration mechanism for an operating member operable to move in a direction away from a predetermined original position, including a force application device for applying a force to the operating member, wherein the force is applied by the force application device to the operating member in such a manner that (1) in the case where the operating member is located at a predetermined point other than the original position, the resultant force acting on the operating member is other than zero and directed toward the original position, and (2) in the case where the operating member is located at the original position, the resultant force is zero.

With the origin restoration mechanism according to the third aspect, in the case where the operating member is located at the original position (in the case of (2)), the resultant force applied to the operating member by the force application means becomes zero, while on the other hand, in the case where the operating member is operated to move and located at another predetermined point than the original position (in the case of (1)), the resultant force applied to the operating member by the force application means assumes a value other than zero and the particular force is directed toward other than the original position. Upon operating the operating member to move in a direction away from the original position against the force in the direction of operation movement, therefore, the resultant force assumes a value other than zero and is directed toward the original position. Upon release of the operating member, the operating member is pushed back toward the original position by the particular force. Once the operating member is restored to the original position, the resultant force becomes zero, and the operating member is held at the original position. As a result, the operating member in a motion for restoration to the original position is prevented from exceeding the original position, thereby improving the accuracy of origin restoration of the operating member.

The aforementioned origin restoration mechanism further includes a plurality of movable members for transmitting the force of the force application means to the operating member. In the case of (1) described above, a part of the plurality of the movable members are brought into contact with the operating member, and the force of the force application means is transmitted to the operating member through the particular part of the movable members in contact. In the case (2), on the other hand, all the plurality of the movable members are in contact with the operating member, and the force of the force application means is applied to the operating member through all the movable members thus in contact.

With this origin restoration mechanism, upon operating the operating member to move in a direction away from the original position against the force in the direction of operative movement, a part of the movable members among the plurality of the movable members located on the side of the operative direction are pushed by the operating member against the force of the force application means and are moved in the direction away from the original position together with the operating member. In the process, the resultant force applied to the operating member through all the movable members assumes a value other than zero, and the force applied to the operating member through the part of the movable members is directed toward the original position. After that, upon release of the operating member, the operating member is pushed back to the original position by the force through the particular part of the movable members. Once the operating member comes to be located at the original position, the remaining movable members come into contact with the operating member. At the same time, the operating member is prevented by the force applied through the remaining movable members from exceeding the original position while being restored. After that, all the movable members come into contact with the operating member, and the resultant force applied to the operating member through all the movable members becomes zero. In this way, in the case where the force of the force application means is transmitted using a plurality of the movable members, the operating member can be operated to move in various directions toward the positions of the plurality of the movable members and can also be restored to the original position. In other words, the directions in which the operating member is operated to move can be varied, thereby advantageously improving the functions of the apparatus.

The plurality of the movable members are arranged in such a manner as to surround the whole periphery of a predetermined plane including the original position. Therefore, the operating member can be operated to move in all the directions around the original position on the predetermined plane. Thus, the functions of the apparatus can be advantageously further improved.

The origin restoration mechanism further includes a distributing member (corresponding to the "rotary unit" in the first embodiment) for distributively transmitting the force of the force application means to the plurality of the movable members.

In this case, the force of a single force application means can be transmitted to the plurality of the movable members distributively through the distributing member, and therefore the is no need to assign one force application means individually to each of the movable members. Thus, the cost is reduced.

According to a fourth aspect of example embodiments of the invention, an origin restoration mechanism for an operating member operable to move in the direction away from a predetermined original position includes a first force application device whereby the operating member located at another position than the original position due to the operation for movement is restored to the original position, and a second force application device for applying a force whereby the operating member restored to the original position by the first force application device is prevented from exceeding the original position.

With the origin restoration mechanism according to the fourth aspect, upon operating the operating member to move in a direction away from the original position, the force is applied to the operating member by the first force application means to return toward the original position. Upon release of the operating member, therefore, the operating member is returned toward the original position by the particular force. Once the operating member is moved and returned to the original position, the second force application means applies a force to the operating member in such a direction as not to exceed the original position. Since the operating member is prevented from exceeding the original position when returning to the original position, the accuracy of origin restoration of the operating member is improved.

The first and second force application means are urging means formed of an elastic material, and further include a first movable member higher in rigidity than the elastic material and a second movable member arranged on the opposite side of the operating member from the first movable member and higher in rigidity than the elastic material. The force of the first force application means is applied to the operating member through the first movable member, while the force of the second force application means is applied to the operating member through the second movable member.

In this case, the force of the first force application means is applied to the operating member through the first movable member, while the force of the second force application member is applied to the operating member through the second movable member. In this way, by applying the forces of the first and second force application means to the operating member through the first and second movable members higher in rigidity than the elastic material of the first and second force application members, the instability can be prevented which the operating member poses in the case where the elastic material is brought into direct contact with the operating member. Thus, the accuracy of origin restoration of the operating member is improved.

The first force application means and the second force application means double as each other. In this case, the first and second force application means can also exhibit the functions of the second and first force application means, respectively. As a result, the number of the parts can be reduced and the structure simplified. This advantageously leads to a configuration in which the accuracy of origin restoration is easily improved.

This origin restoration mechanism is so configured that the first movable member is moved toward the original position when transmitting the force of the first force application means to the operating member, and the second movable member is moved in such a direction as to prevent the operating member from exceeding the original position when applying the force of the second force application means to the operating member, wherein the first force application means and the second force application means share the functions thereof with each other. The origin restoration mechanism further includes a link mechanism for synchronizing said movement of the first movable member with said movement of the second movable member by the forces of the doubled force application means.

This origin restoration mechanism can realize the combination and sharing of the first and second force application means in a simple configuration using the link mechanism. This leads to the advantage that a configuration to improve the accuracy of origin restoration is easily realized.

The origin restoration mechanism described above further includes a rotatable annular rotary unit having a shaft and a fulcrum portion, wherein the first and second movable members engage the shaft and the fulcrum portion, and the link mechanism is so configured that the rotary unit is rotated by the combined force of the function-sharing force application means, which rotation causes the first and second movable members to move in synchronism with each other with the shaft as a rotary axis and the fulcrum portion as a supporting point (the link mechanism corresponds to a configuration according to the third embodiment including the fulcrum portion of the base unit, the rotary unit and the shaft of the rotary unit).

In this origin restoration mechanism, the first and second movable members arranged around the operating member can be easily moved in synchronism with each other, thereby advantageously realizing a configuration with an improved origin restoration accuracy.

The rear end portions of the first and second movable members engage the shaft, while the distal end portions thereof are adapted to contact the operating member. The first and second movable members engage the fulcrum portion at portions between the forward and rear end portions.

In this case, a configuration can be obtained in which the first and second movable members can be efficiently moved. This leads to the advantage that the accuracy of origin restoration is easily improved.

A multi-direction input apparatus according to example embodiments of this invention includes a case body having a ceiling plate with an opening, an operating member operable to move in the X-Y directions from the original position corresponding to the center of the opening of the case body, first and second mobile units movable in the X and Y directions in accordance with the movement of the operating member, first and second signal output device for outputting signals in accordance with the movement of the first and second mobile units, and an origin restoration mechanism for restoring the operating member to the original position according to the first, second, third or fourth aspects described above.

This multi-direction input apparatus produces similar effects to the origin restoration mechanism for the operating member described above.

The urging means is an elastic member. The rotary unit can be formed with a protrusion adapted to be urged by the urging means. In this case, the base unit includes a first accommodating portion in which the protrusion of the rotary unit is inserted and the urging means is accommodated. The portion of the case body in opposed relation to the base unit has a second accommodating portion for accommodating the urging means with the first accommodating portion.

In this case, the urging means constituting an elastic member is accommodated between the first accommodating portion of the base unit and the second accommodating portion of the case body. Therefore, the urging means is prevented from coming off during the assembly process, thereby facilitating the assembly work. As a result, the cost is reduced and the mass-production of the multi-direction input apparatus is facilitated.

The rotary unit and the movable members of the link mechanism are preferably held rotatably between the base unit and the case body.

In this case, the rotary unit and the movable members of the link mechanism are held rotatably between the base unit and the case body, and therefore the assembly work is facilitated. In addition, no extraneous space is generated in the space along the height between the case body and the base unit, thereby advantageously reducing the apparatus height.

BRIEF DECRIPTION OF THE DRAWINGS

Figure 8A:
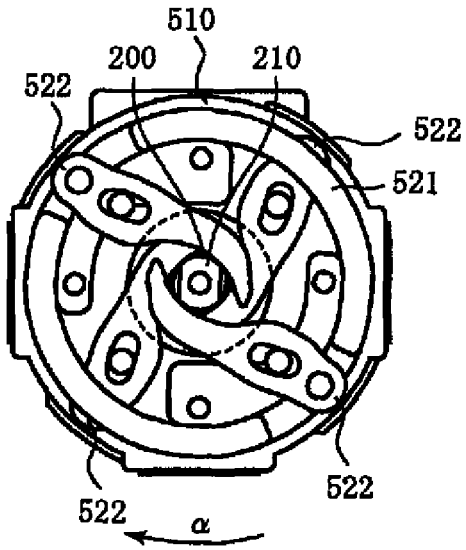
Figure 8B:
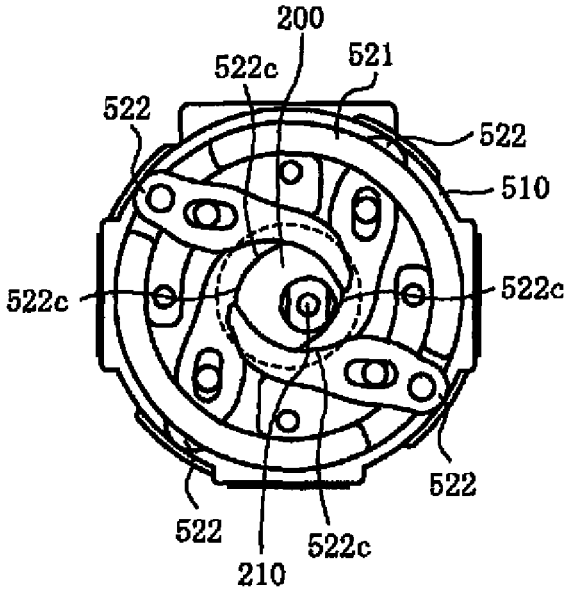
Figure 8C:
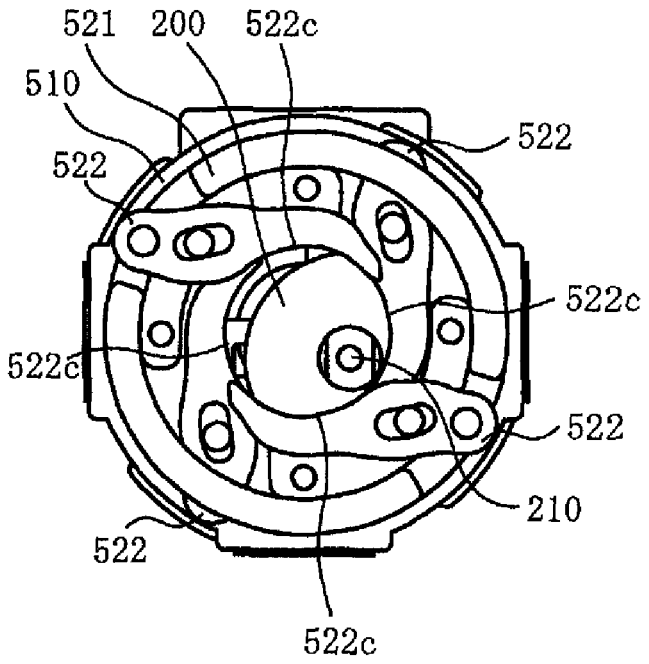

FIG. 8 is a schematic plan view showing the state in which the upper case of the case body of the apparatus is demounted, in which (a) is a diagram showing the state in which the operating member is located at the original position, (b) a diagram showing the state in which the operating member is activated to move right downward in the drawing from the original position and (c) a diagram showing the state in which the operating member is activated to move to the lower right maximum movable position from the original position.

Figure 9A:
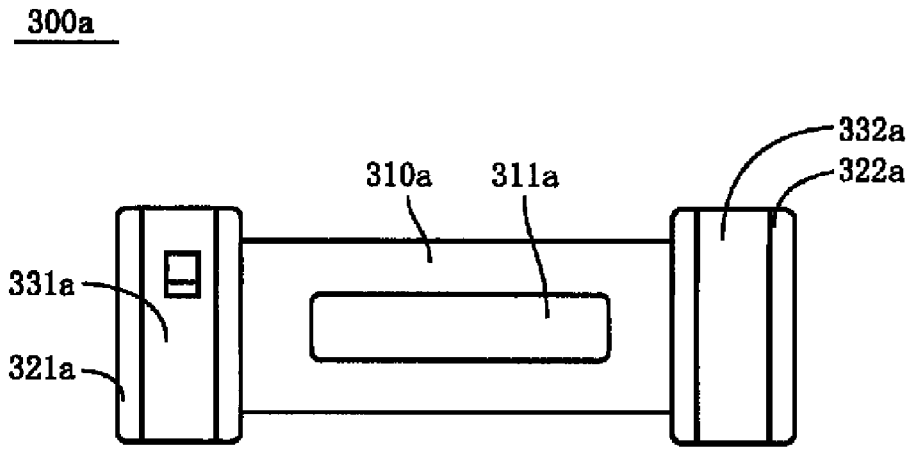
Figure 9B:
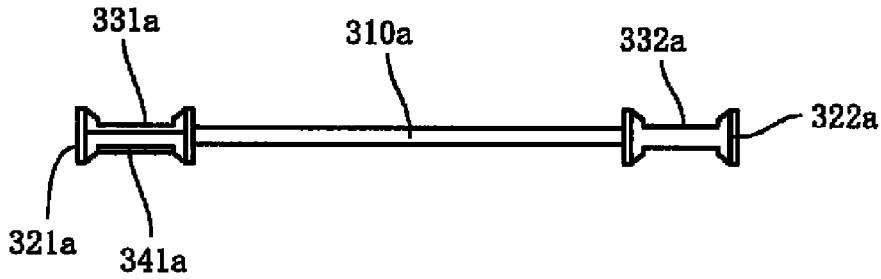
Figure 9C:
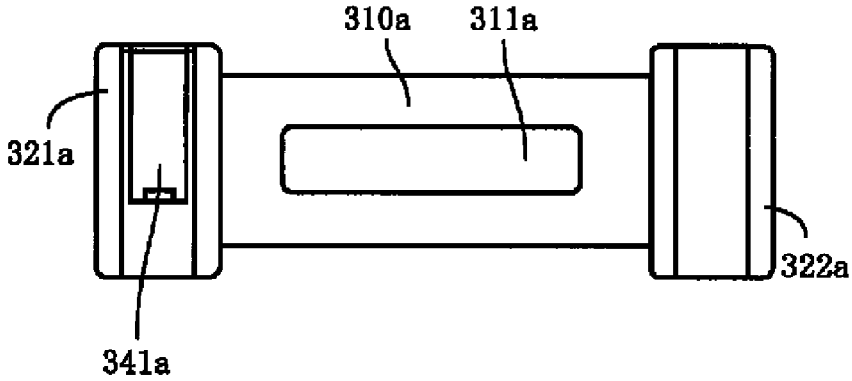

FIG. 9 is a diagram showing the first mobile unit of the apparatus, in which (a) is a schematic plan view, (b) a schematic front view and (c) a schematic bottom view.

Figure 10A:
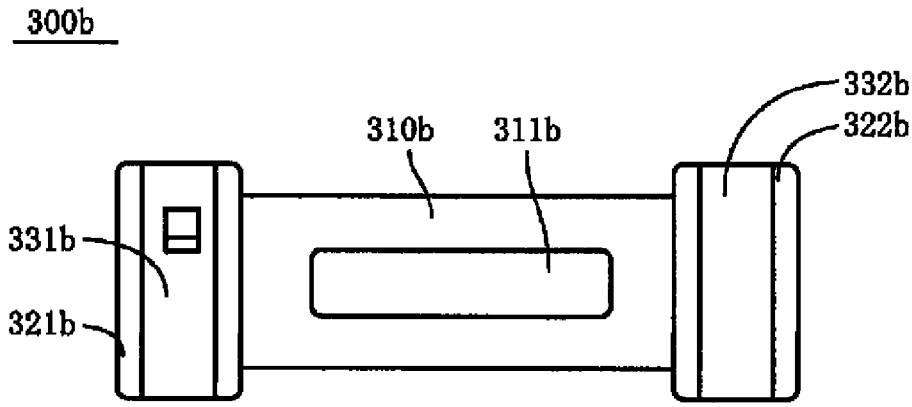
Figure 10B:
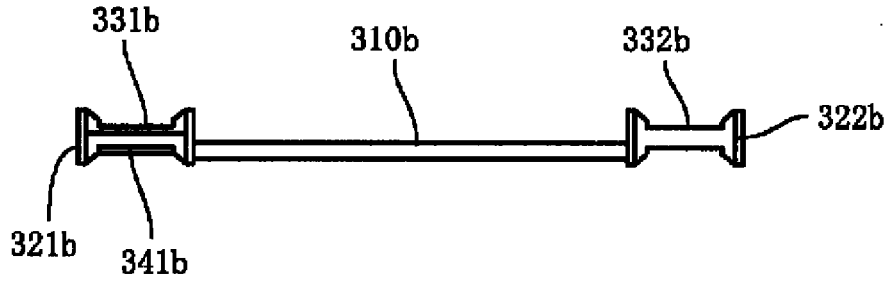
Figure 10C:
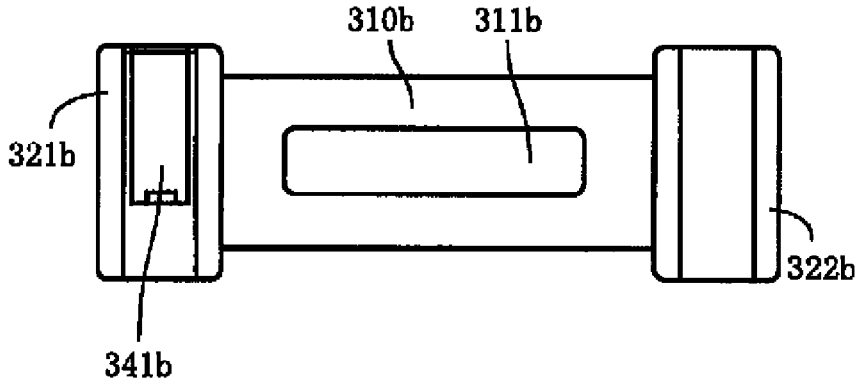

FIG. 10 is a diagram showing the second mobile unit of the apparatus, in which (a) is a schematic plan view, (b) a schematic front view and (c) a schematic bottom view.

Figure 11A:
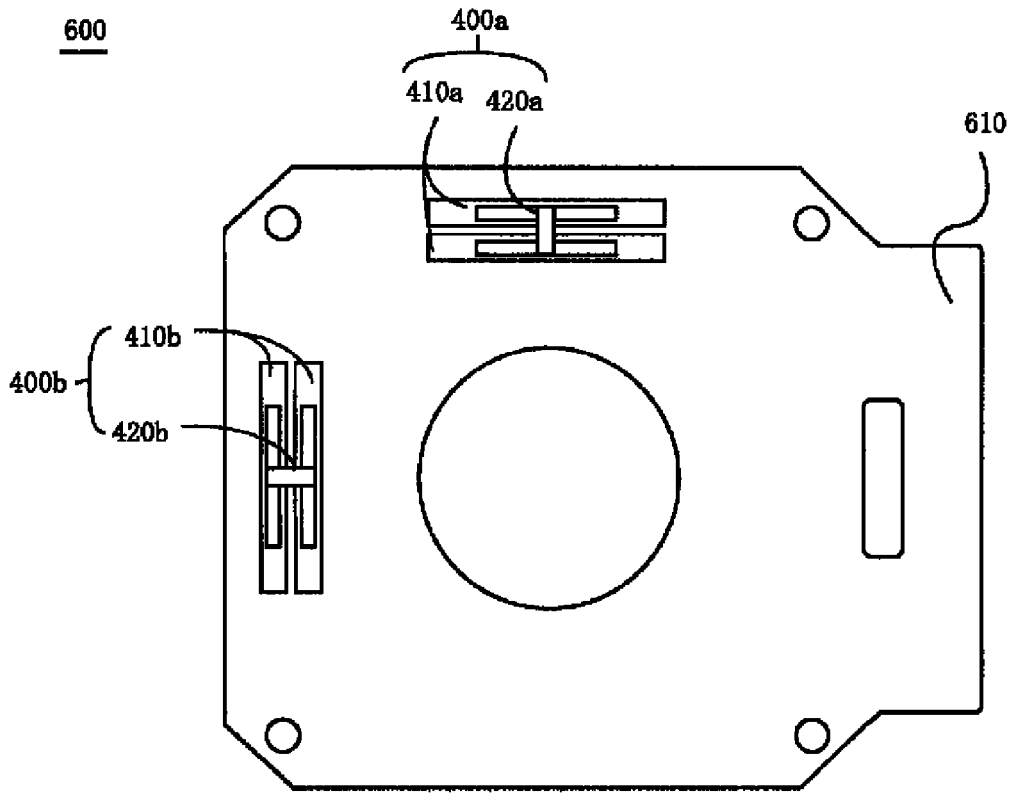
Figure 11B:
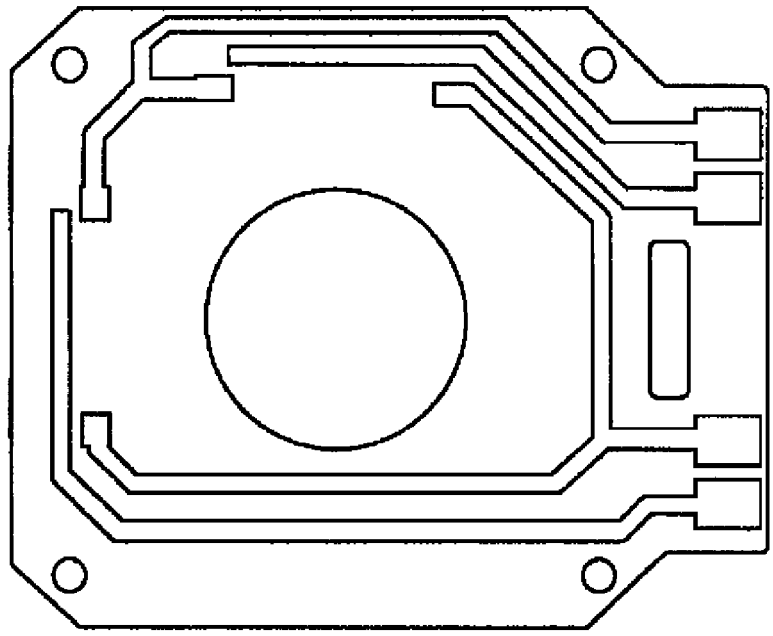

FIG. 11 is a diagram showing a built-in board of the apparatus, in which (a) is a schematic plan view and (b) a schematic bottom view.

Figure 12A:
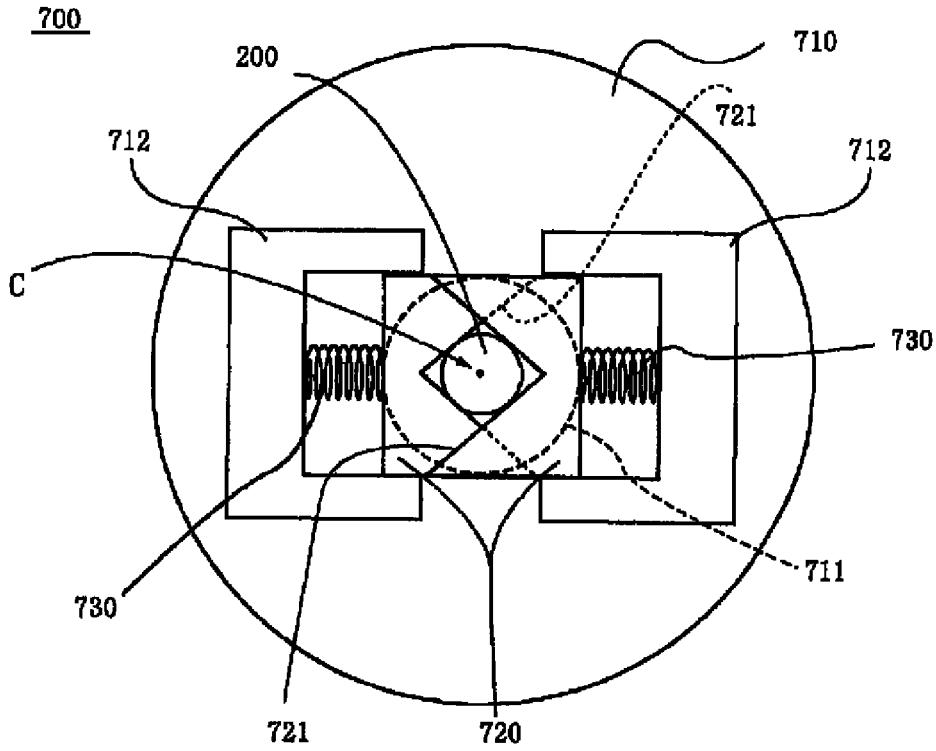
Figure 12B:
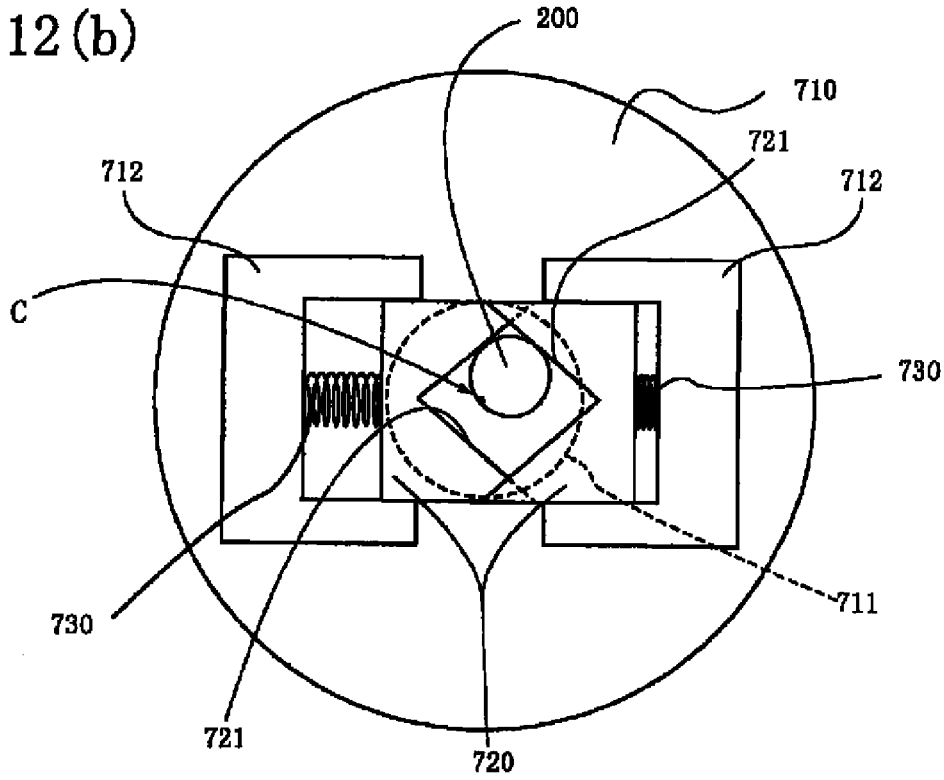

FIG. 12 is a schematic plan view showing the origin restoration mechanism of the multi-direction input apparatus according to a second embodiment of the invention, in which (a) is a diagram showing the state in which the operating member is located at the original position and (b) a diagram showing the state in which the operating member is activated to move diagonally upward in the drawing from the original position.

Figure 13A:
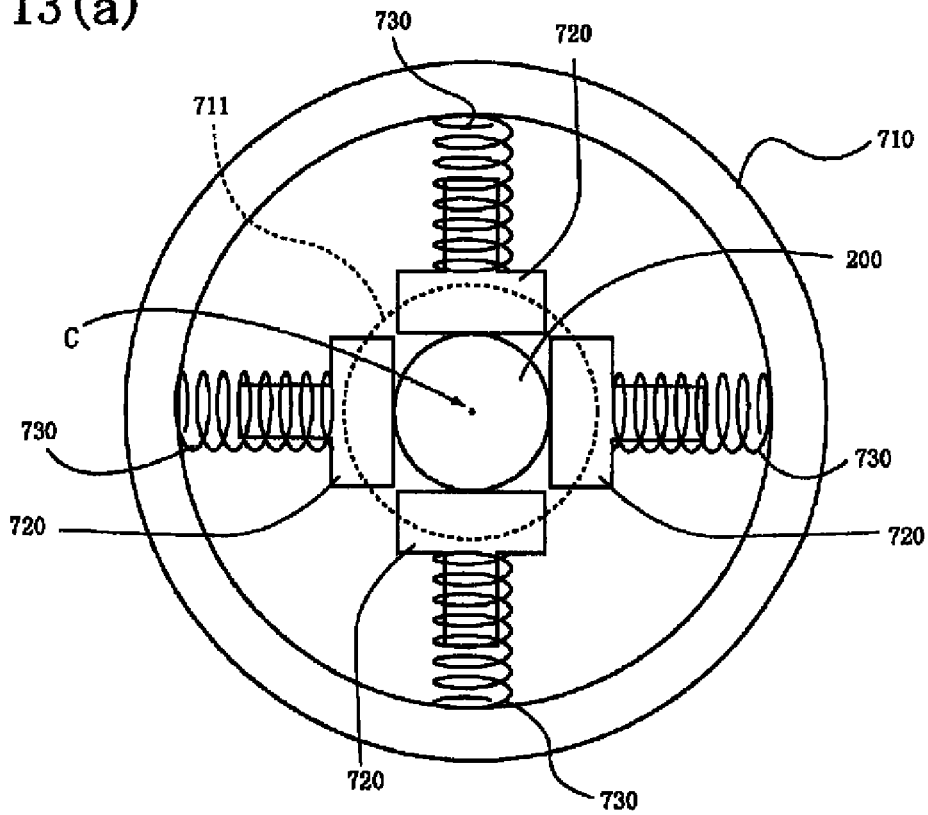
Figure 13B:
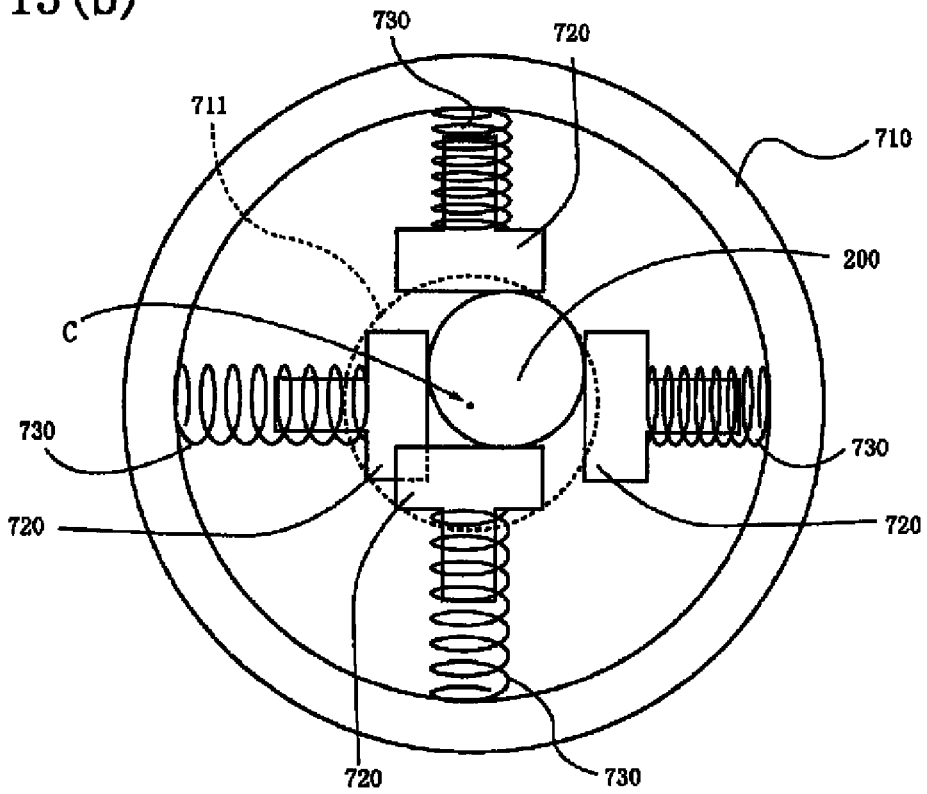

FIG. 13 is a schematic plan view showing an example of the origin restoration mechanism of the apparatus changed in design, in which (a) is a diagram showing the state in which the operating member is located at the original position, and (b) a diagram showing the state in which the operating member is activated to move diagonally upward in the drawing from the original position.

Figure 14:
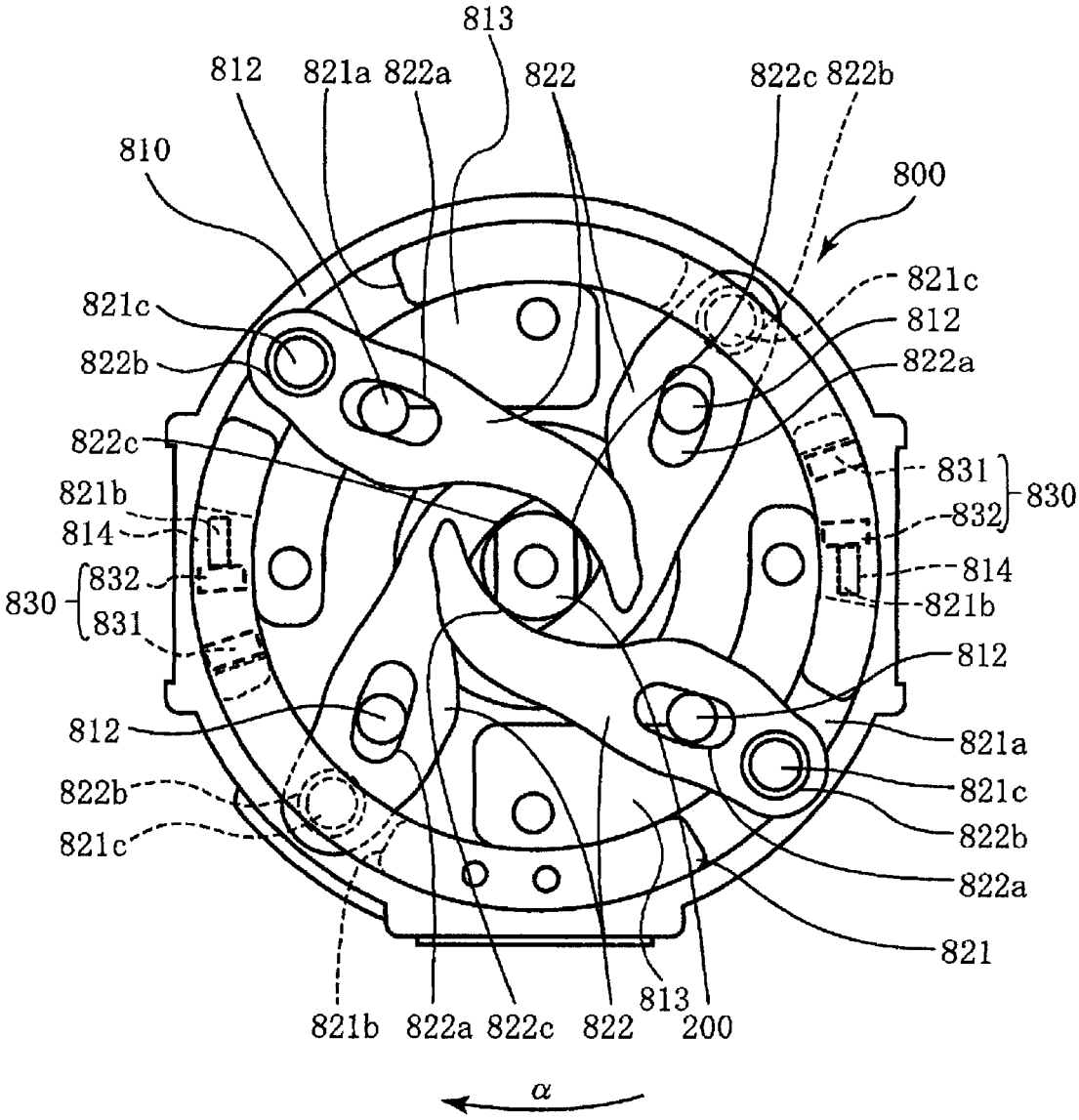

FIG. 14 is a schematic plan view showing the origin restoration mechanism of the multi-direction input apparatus according to a third embodiment of the invention.

Figure 15A:
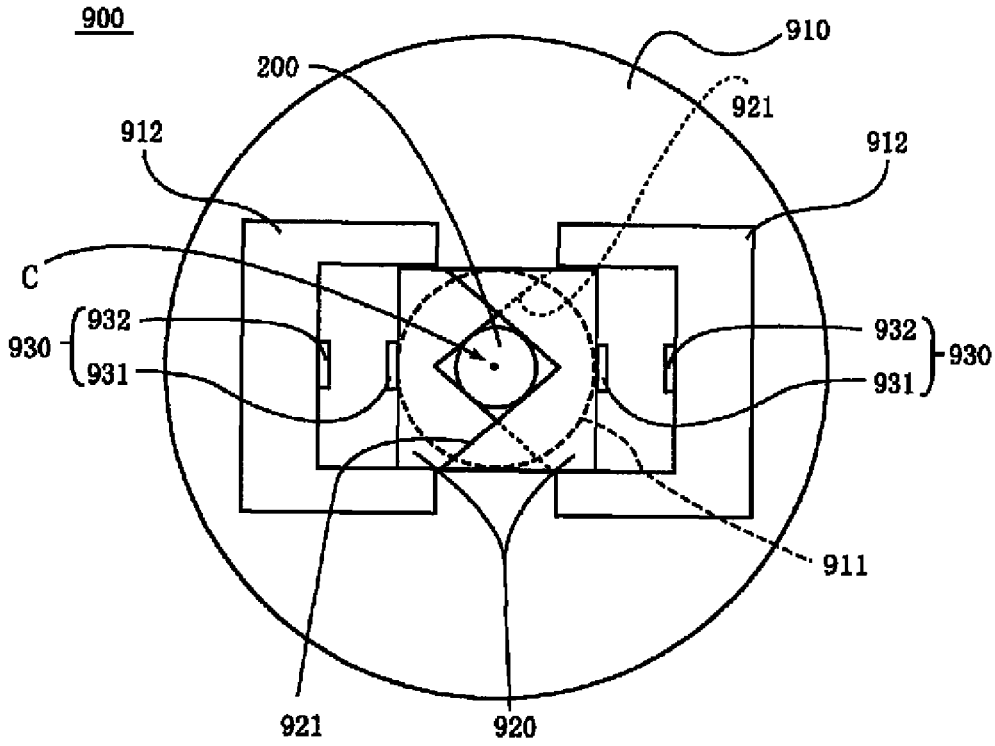
Figure 15B:
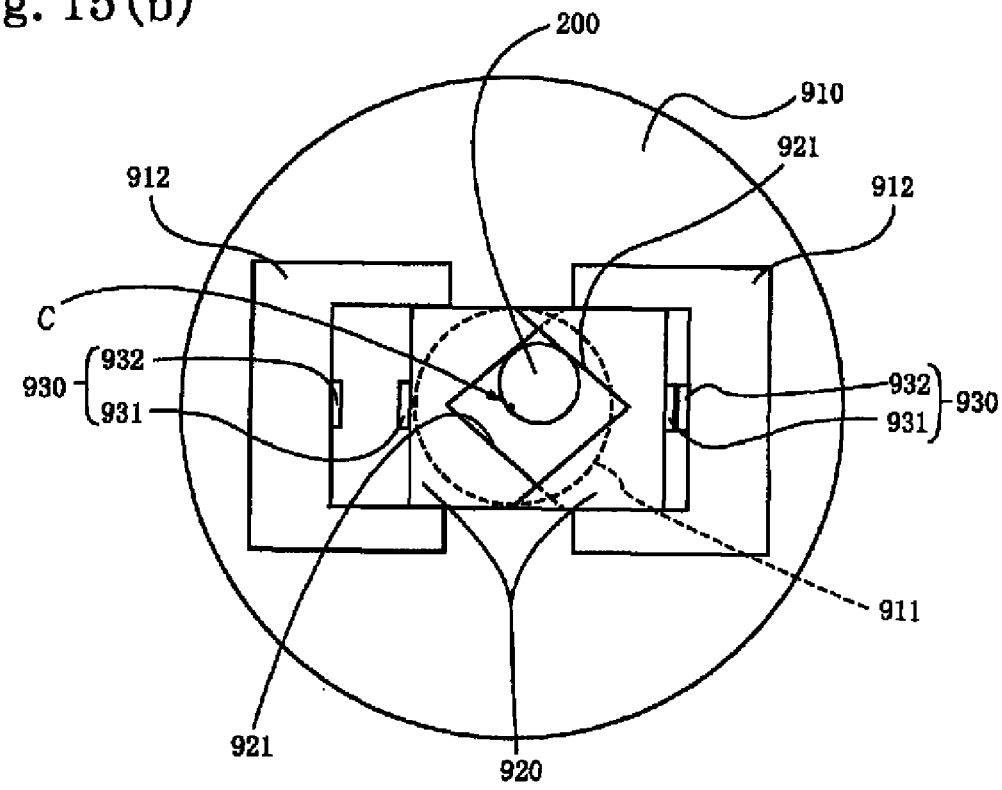

FIG. 15 is a schematic plan view showing the origin restoration mechanism of the multi-direction input apparatus according to a fourth embodiment of the invention, in which (a) is a diagram showing the state in which the operating member is located at the original position and (b) a diagram showing the state in which the operating member is activated to move diagonally upward in the drawing from the original position.

DETAILED DESCRIPTION OF THE NON-LIMITING, EXAMPLE EMBODIMENTS

A multi-direction input apparatus according to example embodiments of this invention is explained below.

Embodiment 1

Figure 1:
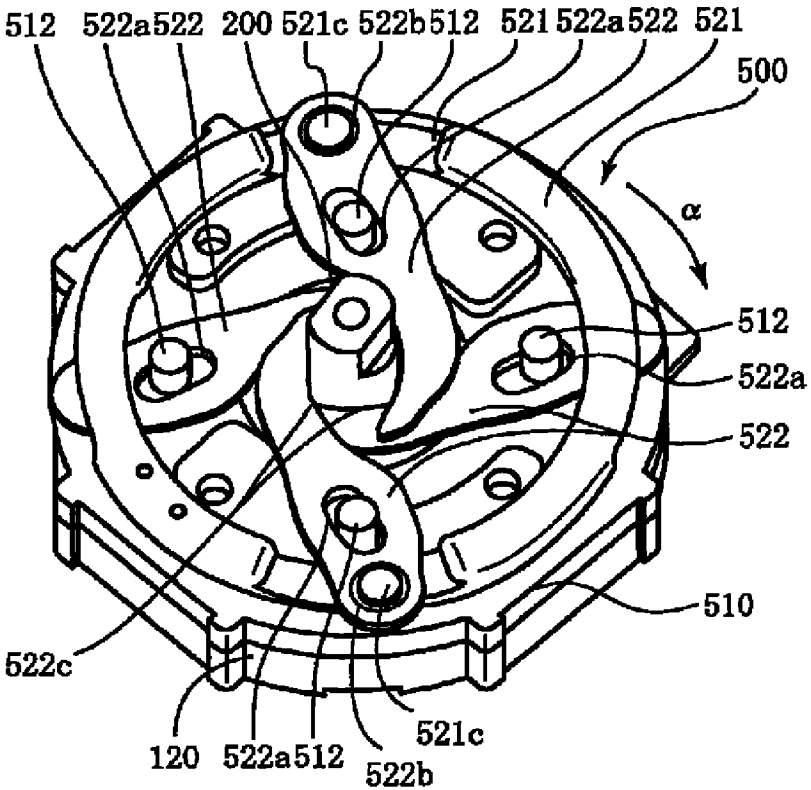
FIG. 1 is a schematic perspective view showing a multi-direction input apparatus according to the first embodiment of the invention, in which (a) is a diagram showing the state in which the upper case of the case body is mounted and (b) a diagram showing the state in which the upper case of the case body is demounted.
Figure 1:
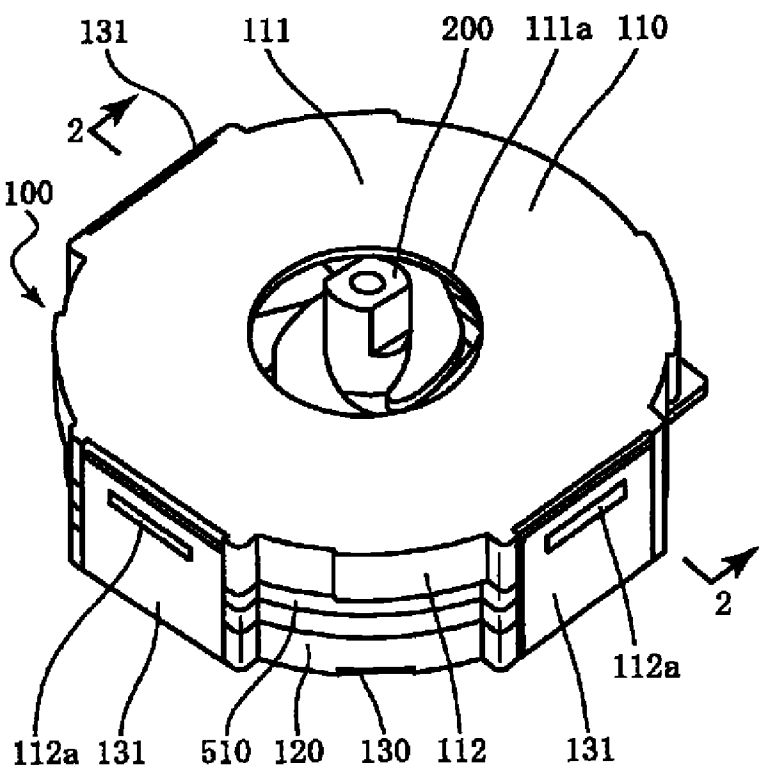

First, a multi-direction input apparatus according to a first embodiment of the invention is explained with reference to the drawings. FIG. 1 is a schematic perspective view showing a multi-direction input apparatus according to the first embodiment of the invention, in which (a) is a diagram showing the state in which the upper case of the case body is mounted and (b) a diagram showing the state in which the upper case of the case body is demounted, FIG. 2 a sectional view taken in line 2-2 of the apparatus, FIG. 3 a schematic plan view showing the state in which the upper case of the case body of the apparatus is demounted, FIG. 4 a schematic perspective view showing the lower case of the case body of the apparatus, FIG. 5 a schematic perspective view showing the base unit of the origin restoration mechanism of the apparatus, FIG. 6 a schematic perspective view showing the rotary unit of the link mechanism of the origin restoration mechanism of the apparatus, FIG. 7 a schematic plan view showing the movable member of the link mechanism of the origin restoration mechanism of the apparatus, FIG. 8 a schematic plan view showing the state in which the upper case of the case body of the apparatus is demounted, in which (a) is a diagram showing the state in which the operating member is located at the original position, (b) a diagram showing the state in which the operating member is activated to move right downward in the drawing from the original position and (c) a diagram showing the state in which the operating member is activated to move to the maximum movable position right downward from the original position, FIG. 9 a diagram showing the first mobile unit of the apparatus, in which (a) is a schematic plan view, (b) a schematic front view and (c) a schematic bottom view, FIG. 10 a diagram showing the second mobile unit of the apparatus, in which (a) is a schematic plan view, (b) a schematic front view and (c) a schematic bottom view, and FIG. 11 a diagram showing a built-in board of the apparatus, in which (a) is a schematic plan view and (b) a schematic bottom view.

Figure 2:
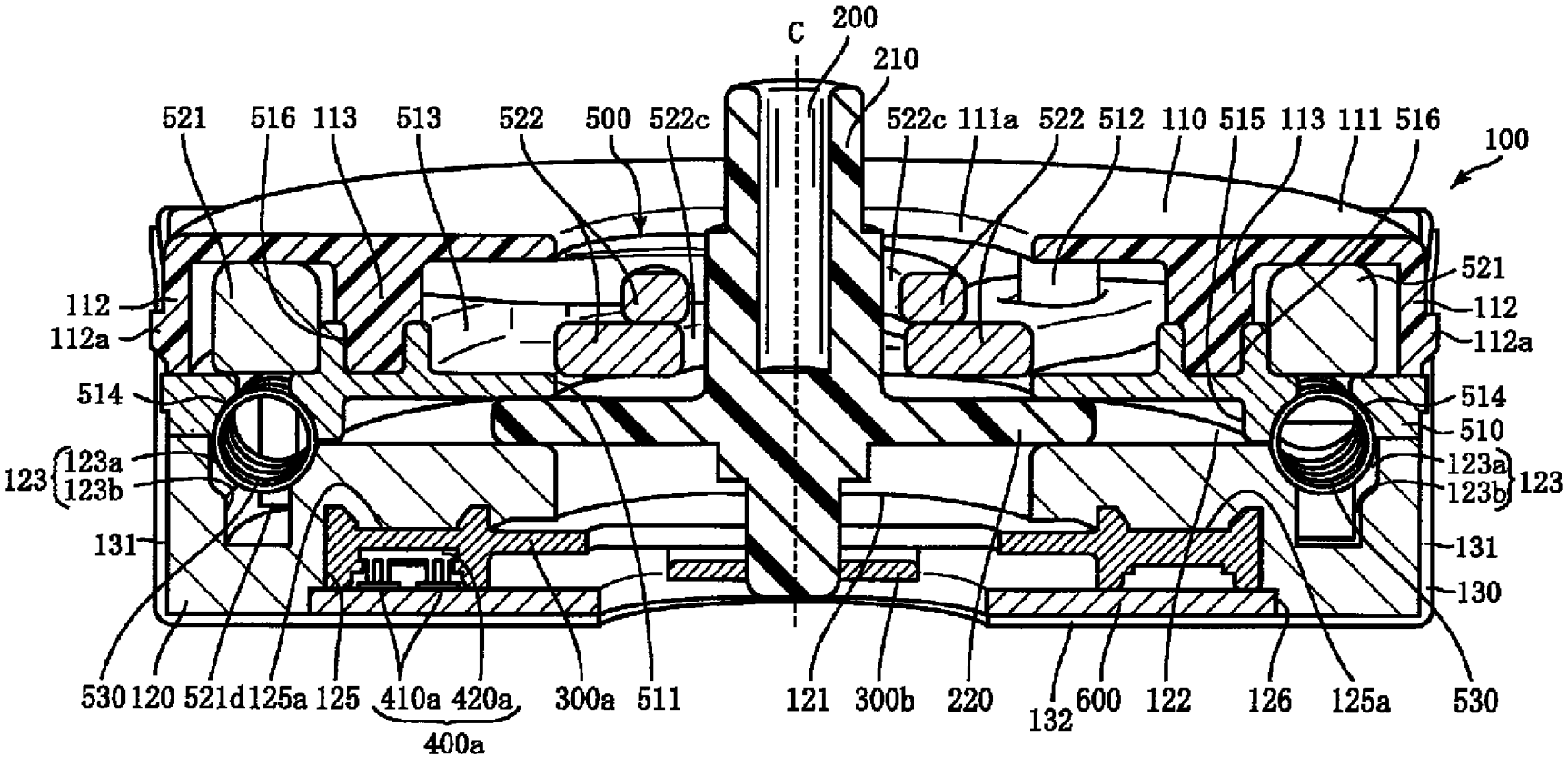
FIG. 2 is a sectional view taken in line 2-2 of the apparatus.

The multi-direction input apparatus shown in FIGS. 1 and 2 includes a case body 100 having a ceiling plate 111 with an opening 111*a*, an operating member adapted to be activated for movement in X-Y directions from the original position C at the center of the opening 111*a* of the case body 100, first and second mobile units 300*a*, 300*b* movable in X and Y directions in the case body 100 in accordance with the movement of the operating member 200, first and second signal output means 400*a*, 400*b* for outputting signals in accordance with the movement of the first and second mobile units 300*a*, 300*b*, and an origin restoration mechanism 500 for urging the operating member 200 from opposite directions thereof with an equal urging force thereby to hold the operating member 200 at the original position C. Each part is explained in detail below.

The operating member 200, as shown in FIG. 2, is a resin molded part and includes a rod-like operating member body 210 and a disk portion 220 arranged integrally at the central portion of the operating member body 210 in a position perpendicular to the operating member body 210.

The case body 100 is configured of an upper case 110, a lower case 120 (supporting part) combined with the upper case 110 while holding the base unit 510 of the origin restoration mechanism 500 with the upper case 110, and a mounting member 130 for mounting the upper case 110, the lower case 120 and the base unit 510 of the origin restoration mechanism 500 integrally with each other.

The upper case 110, as shown in FIG. 2, is a resin molded part including a discal ceiling unit 111 having a circular opening 111*a* at the central portion thereof, an annular side wall portion 112 erected downward from the outer peripheral edge of the ceiling 111, and four solid-cylindrical protrusions 113 (only two of which are shown) formed downward of the ceiling plate 111. The side wall portion 112 is arranged on the edge portion of the upper surface of the base unit 510 of the origin restoration mechanism 500. The outer wall of the side wall portion 112 is formed with three engaging portions 112*a* adapted to be engaged by three engaging hooks 131 of the mounting member 130 (FIGS. 1(*a*) and 2). The protrusions 113 engage the fitting holes 516 of the base unit 510 of the origin restoration mechanism 500.

Figure 4:
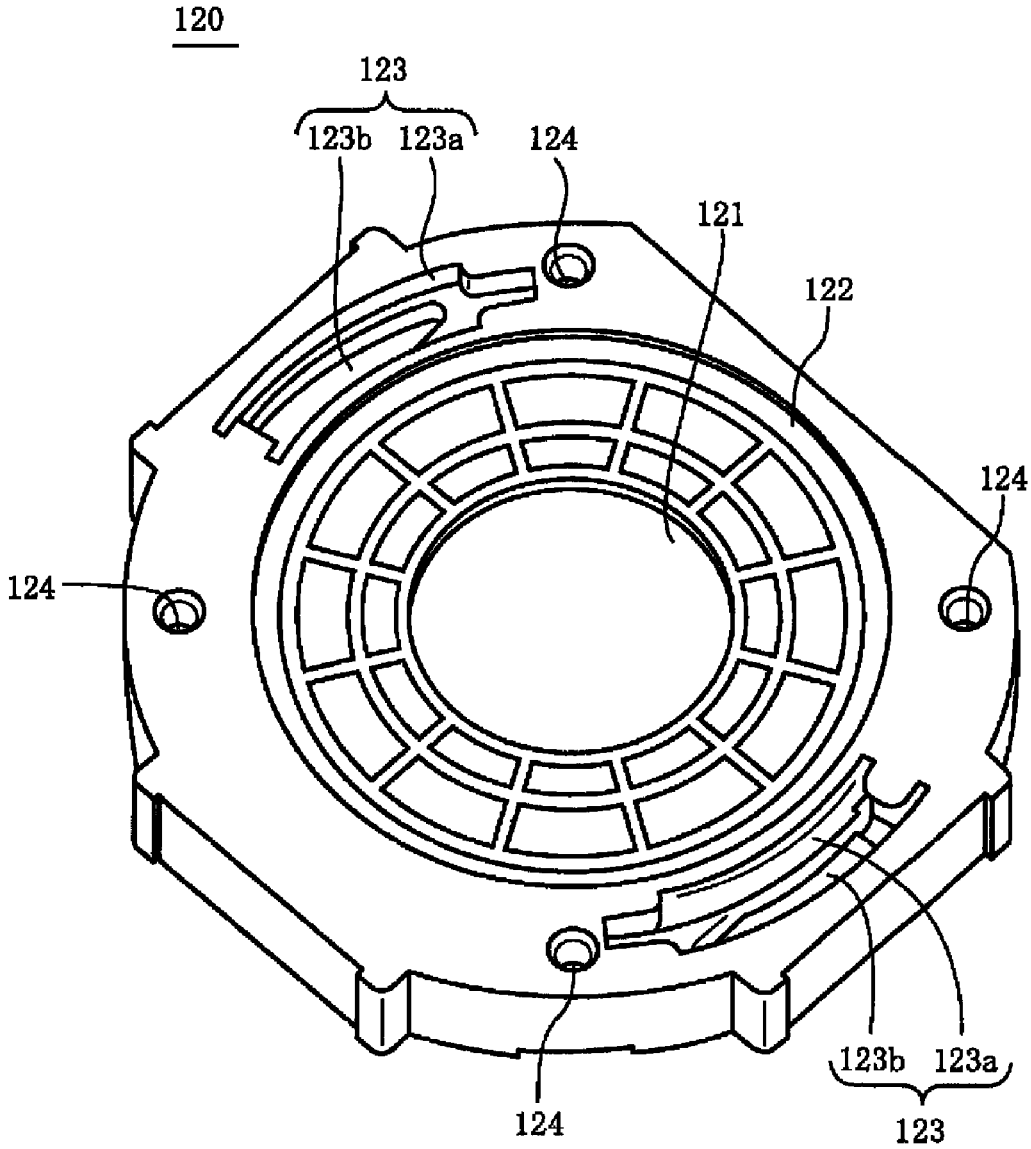
FIG. 4 is a schematic perspective view showing the lower case of the case body of the apparatus.

The lower case 120, as shown in FIGS. 2 and 4, is a substantially circular tabular member with the opposed crests thereof cut and having a circular insertion through hole 121 along the thickness of the central portion thereof. This insertion hole 121, through which the operating member body 210 of the operating member 200 is inserted, has the center thereof located on the vertical line passing through the center of the opening 111*a* of the upper case 110.

The upper surface of the lower case 120 is formed with a circular upper depression 122 continued with the insertion hole 121 and having the center thereof located on the vertical line passing through the center of the opening 111*a* of the upper case 110. This upper depression 122 accommodates the disk 220 of the disk portion 220 of the operating member 200 movably in X-Y directions together with the lower depression 515 of the base unit 510 of the origin restoration mechanism 500.

Also, the upper surface of the lower case 120 is formed with a pair of accommodation grooves 123 (i.e. second accommodation portions) in opposed relation to each other with the insertion hole 121 therebetween. The accommodation grooves 123 have a two-step structure in arcuate form. The upper stage portion 123*a* of the accommodation grooves 123 accommodates the urging means 530 of the origin restoration mechanism 500. The protrusions 521*d* of the rotary unit 521 are inserted into the upper stage portion 123*a* and the lower stage portion 123*b*. Further, four fitting holes 124 in which to fit the four protrusions 517 of the base unit 510 of the origin restoration mechanism 500 are formed at the four corners of the upper surface of the lower case 120 as shown in FIG. 4.

The lower surface 120, on the other hand, is formed with a rectangular first lower depression 125 for accommodating the first and second mobile units 300*a*, 300*b* and a rectangular second lower depression 126 for accommodating a later described built-in board 600 continued downward of the first lower depression, as shown in FIG. 2.

The ceiling surface of the first lower depression 125 carries a pair of first guide portions 125*a* constituting ridges to guide the first mobile unit 300*a* movably in X direction, and a pair of second guide portions, not shown, constituting ridges to guide the second mobile unit 300*b* movably in Y direction and arranged at right angles to the first guide portions 125*a*.

The second lower depression 126 is somewhat wider than the first lower depression 125 with the built-in board 600 fitted therein, and has one end, not shown, open to allow a protrusion 610 of the built-in board 600 to project out of the case body 100.

The mounting member 130, as shown in FIGS. 1 and 2, has a tabular disk member 132 and four engaging hooks 131 erected vertically from the tabular member 132. The tabular member 132 is arranged on the lower surface of the lower case 120 in such a manner as to close the second lower depression 126 of the lower case 120. The built-in board 600 is held between the second lower depression 126 of the lower case 120 and the tabular member 132 of the mounting member 130

One of the four engaging hooks 131, though not shown, is smaller in height than the remaining three. The three engaging hooks 131 are adapted to engage the engaging portions 112*a* of the upper case 110 in the state where the upper case 110, the base unit 510 of the origin restoration mechanism 500 and the lower case 120 are combined with each other. The first one of the engaging hooks 131 is adapted to engage the engaging portion, not shown, of the lower case 120 in the state where the upper case 110, the base unit 510 of the origin restoration mechanism 500 and the lower case 120 are combined with each other.

Figure 3:
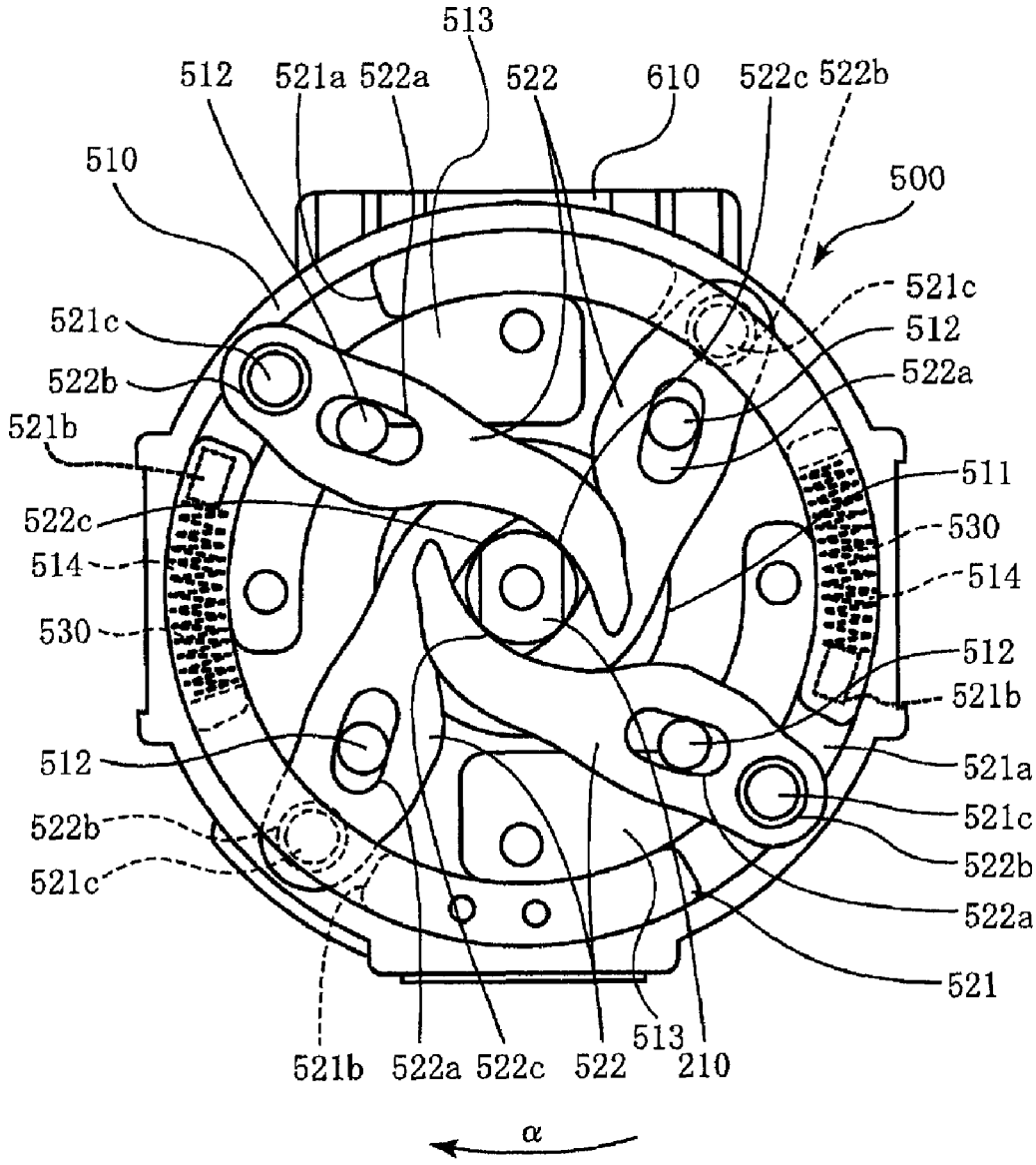
FIG. 3 is a schematic plan view showing the state in which the upper case of the case body of the apparatus is demounted.

The origin restoration mechanism 500, as shown in FIGS. 2 and 3, has a base unit 510 arranged in X-Y directions across the axis of the operating member body 210 of the operating member 200, a link mechanism 520 arranged on the upper surface of the base unit 510 and a pair of urging means 530 (force application means) for urging the rotary unit 521 of the link mechanism 520 in a predetermined peripheral direction α.

The base unit 510 is a substantially circular tabular member sandwiched between the upper case 110 and the lower case 120, and has the central portion thereof formed with a hole 511 through which to insert the operating member body 210 of the operating member 200. The hole 511 has the center thereof located on the vertical line passing through the center of the opening 111*a* of the upper case 110 and, with the opening 111*a*, restricts the movement of the operating member 200 over more than a predetermined distance in X-Y directions. Specifically, the operating member 200 is movable in X-Y directions only in the range within the hole 511.

Figure 5:
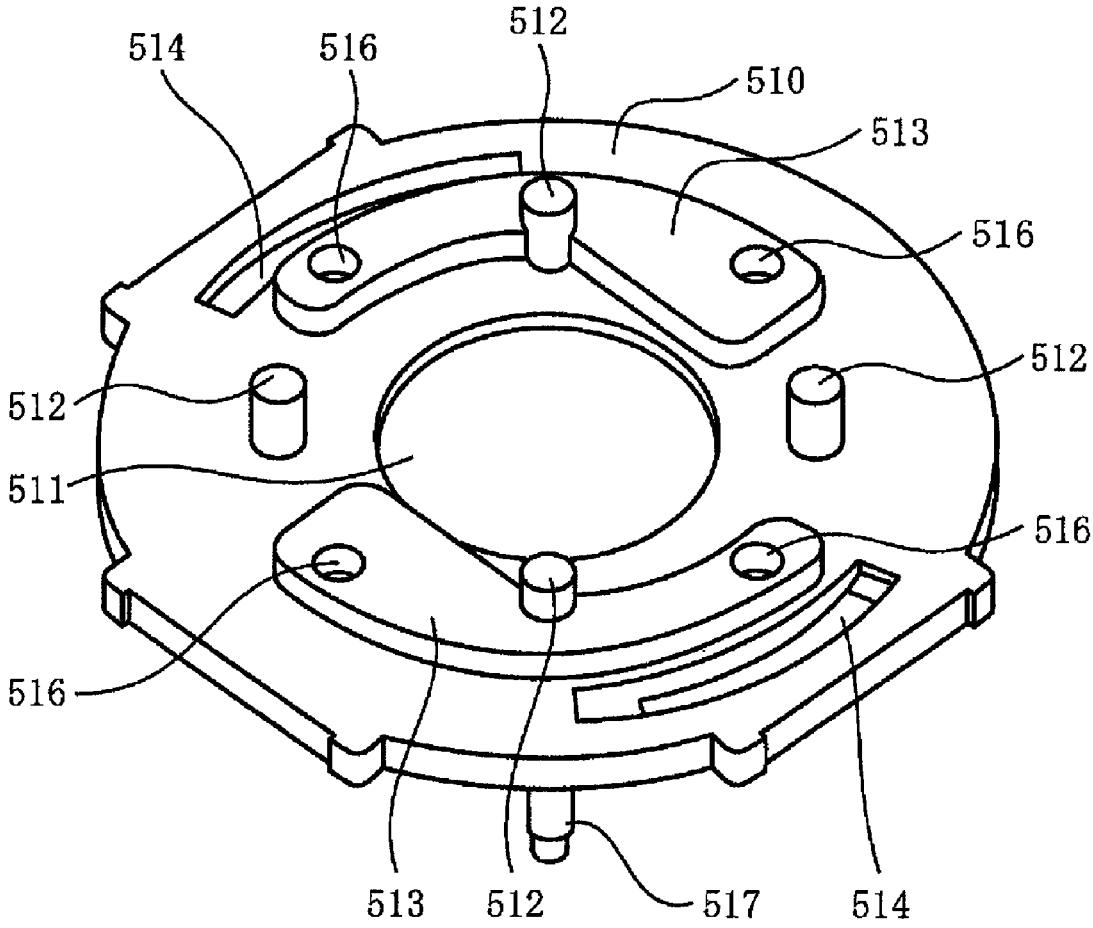
FIG. 5 is a schematic perspective view showing the base unit of the origin restoration mechanism of the apparatus.

Four solid-cylindrical fulcrum portions 512 are arranged at pitches of 90° around the hole 511 on the upper surface of the base unit 510 as shown in FIGS. 3, 5. Movable members 522 of the link mechanism 520 are mounted rotatably on the fulcrum portions 512.

The two opposed ones of the four fulcrum portions 512 have two supports 513 for supporting the movable members 522, respectively. The supports 513 are for changing the height of the mounting position of the two movable members 522 supported and the remaining two movable members 522 supported on the upper surface of the base unit 510. By changing the height of the mounting position of the movable members 522 in this way, the four movable members 522 can be arranged closely at pitches of 90° around the axis of the operating member body 210 of the operating member 200 on the upper surface of the base unit 510.

The supports 513 of the base unit 510 are formed at the ends thereof with fitting holes 516 into which the protrusions 113 of the upper case 110 are fitted as shown in FIGS. 2 and 5.

A pair of accommodation holes 514 (i.e. first accommodation portions) for accommodating a pair of the urging means 530, together with a pair of the accommodating grooves 123 of the lower case 120, are formed on the outer side portions of the supports 513 on the upper surface of the base unit 510. The accommodation holes 514 are curved arcuately along the rotary unit 521. Also, the lower edge of each accommodation hole 514, as shown in FIG. 2, forms an arcuate tapered surface progressively wider downward. Specifically, the distance between the upper edges of the accommodation holes 514 is smaller than the width of the urging means 530, so that the protrusions 521*d* of the rotary unit 521 can be inserted while at the same time preventing the urging means 530 from coming off upward.

The lower surface of the base unit 510, on the other hand, is formed with a circular lower depression 515 for accommodating the disk 220 of the operating member 200 together with the upper depression 122 of the lower case 120, as shown in FIG. 2. The center of the lower depression 515 is located on the vertical line passing through the center of the opening 111*a* of the upper case 110. Also, the height of the lower depression 515 plus the height of the upper depression 122 of the lower case 120 is somewhat larger than the thickness of the disk 220 of the operating member 200. In other words, the movement of the operating member 200 in Z direction is restricted by the lower depression 515 of the base unit 510 and the upper depression 122 of the lower case 120.

Also, the lower surface of the base unit 510, as shown in FIG. 5, is formed with four solid-cylindrical protrusions 517 (of which only one is shown) at predetermined intervals and adapted to be fitted in the four fitting holes 124 of the lower case 120.

The link mechanism 520 includes a rotary unit 521 (distributing member) arranged rotatably around the axis of the operating member body 210 on the upper surface of the base unit 510, and four movable members 522 arranged around the axis of the operating member body 210 inside the rotary unit 521 on the surface of the base unit 510.

Figure 6:
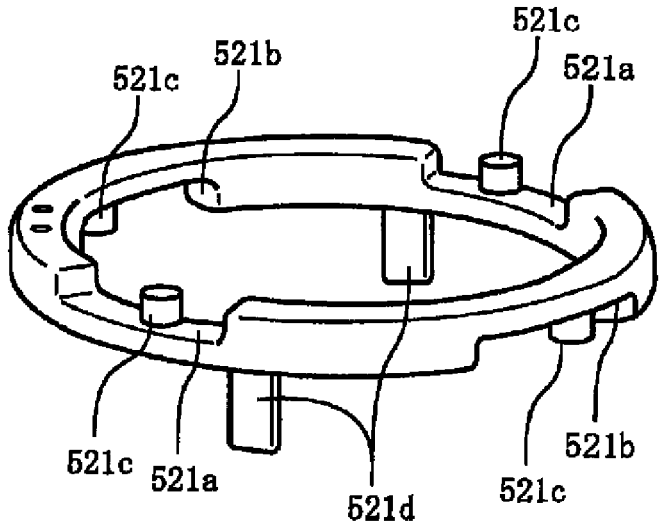
FIG. 6 is a schematic perspective view showing the rotary unit of the link mechanism of the origin restoration mechanism of the apparatus.

The rotary unit 521 is an annular member, and as shown in FIGS. 2, 3 and 6, includes a pair of upward depressions 521*a* in opposed relation to each other and a pair of downward depressions 521*b* in opposed relation to each other. Specifically, the upward depressions 521*a* and the downward depressions 521*b* are arrange alternately with each other at pitches of 90°. The upward depressions 521*a* and the downward depressions 521*b* each have a solid-cylindrical shaft portion 521*c* for coupling the rear end portions of the movable members 522 rotatably.

Also, the rotary unit 521 has a pair of downward protrusions 521*d* in opposed relation to each other. The protrusions 521*d* are inserted into the accommodation holes 514 of the base unit 510 and the accommodating grooves 123 of the lower case 120. As a result, the rotary unit 521 is mounted rotatably on the upper surface of the base unit 510.

Figure 7:
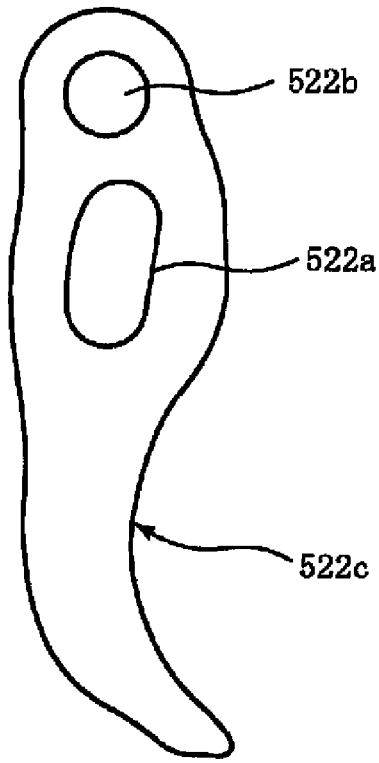
FIG. 7 is a schematic plan view showing a movable member of the link mechanism of the origin restoration mechanism of the apparatus.

The movable members 522, as shown in FIGS. 3 and 7, are tabular pieces for converting the movement of the operating member 200 into the rotation of the rotary unit 521, and formed of a material higher in rigidity than the urging means 530. As a result, the urging force of the urging means 530 is accurately transmitted to the operating member 200.

The intermediate portion of each movable member 522 is formed with a slot 522*a* into which the fulcrum portion 512 of the base unit 510 is inserted. By inserting the shafts of the base unit 510 into the slots 522*a*, two movable members 522 are mounted rotatably on the supports 513 of the base unit 510, while the remaining two movable members 522 are mounted rotatably on the upper surface of the base unit 510. As a result, the four movable members 522 are arranged at pitches of 90° around the axis of the operating member body 210 of the operating member 200 on the upper surface of the base unit 510.

A circular connecting hole 522*b* into which the shaft 521*c* of the rotary unit 521 is to be inserted is formed at the rear end portion of each movable member 522. As a result, the rear end portion of the movable member 522 is rotatably coupled to the rotary unit 521 so that the rotary unit 521 rotates with the rotation of the movable members 522.

The inside part (one transverse end surface) of the distal end portion of each movable member 522, on the other hand, is formed with an arcuate notch 522*c* constituting a portion contacted by the operating member body-210 of the operating member 200 located at the original position C. Specifically, the four movable members 522 are in contact with different points on the outer surface of the operating member body 210 of the operating member 200 at the original position C thereby to hold the operating member 200 at the original position C.

Each notch 522*c* comes to form the same arc, in plan view, as the edge portion of the hole 511 of the base unit 510 when the operating member 200 moves to the maximum movable position (refer to FIG. 8(*c*)). When the operating member 200 is located at the maximum movable position, therefore, the load due to the urging force of the urging means 530 is substantially equally exerted in all the operative directions of the operating member body 210 of the operating member 200 through the rotary unit 521 and a part of the movable members 522 in contact therewith. As a result, the rotation of the operating member 200 is smoothed for an improved operation feeling.

The pair of the urging means 530, as shown in FIG. 3, are coil springs accommodated between the accommodation groove 123 of the lower case 120 and the accommodation hole 514 of the base unit 510. The pair of the urging means 530 thus accommodated urges a pair of protrusions 521*d* of the rotary unit 521 in direction α. Specifically, the urging force of the pair of the urging means 530 is divided into four components through the rotary unit 521 and the four movable members 522 and equally exerted on the operating member 200 located at the original position C.

The first and second mobile units 300*a*, 300*b*, as shown in FIGS. 2, 3, are arranged at right angles to each other in the first lower depression 125 of the lower case 120. The first mobile unit 300*a*, as shown in FIGS. 2, 9, includes a tabular portion 310*a* extending in the direction perpendicular to the direction (X) of movement and slider portions 321*a*, 322*a* arranged at the longitudinal ends of the tabular portion 310*a*.

The upper surface of the slider portion 321*a* is formed with a depressed groove 331*a* fitted slidably on one of the first guide portions 125*a* of the lower depression 125 of the lower case 120. In similar fashion, the upper surface of the slider portion 322*a* is formed with a depressed groove 332*a* fitted slidably in the other first guide portion 125*a* of the lower depression 125 of the lower case 120. Also, the lower surface of the slider portion 321*a* has an accommodation portion 341*a* for accommodating a first contactor 420*a* of the first signal output means 400*a*.

The tabular portion 310*a* has a slot 311*a* extending in the direction perpendicular to the X direction. The operating member body 210 of the operating member 200 is inserted in the slot 311*a*. Specifically, the transverse end surface of the slot 311*a* is pushed by the operating member body 210, so that the grooves 331*a*, 332*a* of the slider portions 321*a*, 322*a* are guided by the pair of the first guide portions 125*a* of the lower depression 125 of the lower case 120 and the first mobile unit 300*a* moves along the surface of the built-in board 600 in X direction.

The second mobile unit 300*b*, as shown in FIG. 10, has a substantially similar configuration to the first mobile unit 300*a* except that the tabular portion 310*a* of the second mobile unit 300*b* is arranged at the lower end of the slider portions 321*b*, 322*b* in order that the tabular portion 310*b* of the second mobile unit 300*b* can be arranged at right angles to the tabular portion 310*a* of the first mobile unit 300*a*. Similar or identical components are therefore not described again.

The first and second signal output means 400*a*, 400*b*, as shown in FIGS. 2 and 11, have first and second resistor circuits 410*a*, 410*b* arranged on the surface of the built-in board 600 and first and second contactors 420*a*, 420*b* in sliding contact with the first and second resistor circuits 410*a*, 410*b*. The first and second contactors 420*a*, 420*b* are accommodated in the accommodation portions 341*a*, 341*b* of the slider portions 321*a*, 321*b* of the first and second mobile units 300*a*, 300*b*, and adapted to come into sliding contact with the first and second resistor circuits 410*a*, 410*b*, respectively, by the movement of the first and second mobile units 300*a*, 300*b*. In other words, the change in resistance value due to the sliding contact is output externally as an output signal through the built-in board 600.

The built-in board 600, as shown in FIG. 11, is a rectangular printed board formed with the first and second resistor circuits 410*a*, 410*b* of the first and second signal output means 400*a*, 400*b*. A protrusion 610 is projected out of the case body 100 from an end of the built-in board 600. This protrusion 610 is used for external connection.

The method of using this multi-direction input apparatus and the operation of each component part thereof are described below. First, the operating member 200 (refer to FIG. 8(*a*)) located at the original position C is activated to move right downward in the drawing.

Then, the notches 522*c* at the distal ends of a part of the movable members 522 located in the direction of movement (the movable member 522 at upper right position in this case) are pushed by the operating member body 210 of the operating member 200 against the urging force of the urging means 530 through the rotary unit 521 thereby to rotate the particular part of the movable members 522. This rotation, as shown in FIG. 8(*b*), causes the rotation of the rear end portion of the particular part of the movable members 522 and the rotary unit 521*a* is rotated in the direction opposite to α. With the rotation of the rotary unit 521, the rear end portions of the remaining movable members 522 are rotated thereby to rotate the remaining movable members 522. Also, the urging means 530 is compressed by the rotation of the rotary unit 521. In the process, the four divisions of the urging force are unequally exerted on the operating member 200 through the rotary unit 521 of a pair of the urging means 530 and the four movable members 522. Actually, only one urging force generated through a part of the movable members 522 is exerted on the operating member 200.

Upon activation and movement of the operating member 200, the first mobile unit 300*a* moves in X direction, and the first contactor 420*a* slides over the first resistor circuit 410*b*. At the same time, the second mobile unit 300*b* moves in Y direction, and the second contactor 420*b* slides over the second resistor circuit 410*b*. Then, the resistance value changed in accordance with the amount of movement of the first mobile unit 300*a* is output as a first output signal of the first signal output means 400*a* and input to an electronic device for which the multi-direction input apparatus is used. At the same time, the resistance value changed in accordance with the amount of movement of the second mobile unit 300*b* is output as a second output signal of the second signal output means 400*b* and input to the electronic device.

The electronic device detects the movement and the amount of movement of the operating member 200 in X direction based on the first output signal on the one hand, and the movement and the amount of movement of the operating member 200 in Y direction based on the second output signal on the other hand. The electronic device thus determines from this signal combination that the operating member 200 is activated right downward diagonally in the drawing.

After that, upon release of the operating member 200, the rotary unit 521 is rotated in direction α by the urging force of the urging means 530 compressed. As a result, all the movable members 522 are rotated, and the distal end portion of each movable member 522 is moved toward the original position C. In the process, the notches 522*c* at the distal end portions of a part of the movable members 522 push the operating member body 210 back toward the original position C. Upon restoration of the operating member body 210 to the original position C, the four movable members 522 come into contact with different portions of the outer surface of the operating member body 210, and the operating member 210 is held by the particular movable members 522. At the same time, the four divisions of the urging force of the pair of the urging means 530 are equally exerted on the operating member 200 and act on each other through the rotary unit 521 and the four movable members 522. As a result, the operating member 200 is held at the original position C.

Incidentally, in the case where the operating member 200 is activated to move in X direction, only the first mobile unit 300*a* is moved and the first output signal is output from the first signal output means 400*a*. Upon activation of the operating member 200 to move in Y direction, on the other hand, only the second mobile unit 300*b* moves and the second output signal is output from the second signal output means 400*b*. In these cases, the operation is the same as described above, except that a part of the movable members 522 are different which are pushed by the operating member body 210 of the operating member 200 and which push back the particular operating member body 210. This is also the case with the activation of the operating member 200 to move in other directions.

In this multi-direction input apparatus, the operating member body 210 of the operating member 200, once restored to the original position C, is held and controlled by the four movable members 522. Unlike in the prior art, therefore, the operating member is not moved beyond the original position C, and the restoration operation of the operating member 200 is improved in accuracy. Further, upon movement of the operating members 200 to the maximum movable position, the notches 522*c* of the movable members 522 assume the same shape of arc, in plan view, as the edge portion of the hole 511 of the base unit 510. Once the operating member 200 comes to be located at the maximum movable position, therefore, the load is exerted on the operating member body 210 of the operating member 200 substantially equally in all directions of operation. As a result, the rotational operation of the operating member 200 is smoothed for an improved operation feeling.

Embodiment 2

Next, the multi-direction input apparatus according to a second example embodiment of the invention is explained with reference to the drawings. FIG. 12 is a schematic plan view showing an origin restoration mechanism of the multi-direction input apparatus according to the second example embodiment of the invention, in which (a) is a diagram showing the state in which the operating member is located at the original position, (b) a diagram showing the state in which the operating member is activated to move diagonally upward in the drawing from the original position. FIG. 13 is a schematic plan view showing a design change of the origin restoration mechanism of the apparatus, in which (a) is a diagram showing the state in which the operating member is located at the original position, and (b) a diagram showing the state in which the operating member is activated to move diagonally upward in the drawing from the original position.

The multi-direction input apparatus shown in FIG. 12 has a similar configuration to the multi-direction input apparatus according to the first embodiment except for the configuration of the origin restoration mechanism 700. The points of the difference are explained in detail below, while similar or identical parts are not explained. The origin restoration mechanism is designated by reference numeral 700, and the other component parts are designated by the same reference numerals, respectively, as in the first embodiment.

The origin restoration mechanism 700 includes a base unit 710 arranged to cross the axis of the operating member 200, a pair of movable members 720 arranged movably toward the operating member 200 in opposed relation to each other with the operating member 200 therebetween on the surface of the base unit 710, and a pair of urging means 730 (force application means) for urging the movable members 720 toward the original position C.

The base unit 710, like the base unit 510, is a substantially circular tabular member held between the upper case 110 and the lower case 120. A hole 711 through which the operating member body 720 of the operating member 200 is inserted is formed at the central portion of the tabular member.

A pair of depressed guide portions 712 for guiding a pair of the movable members 720 to move toward the operating member 200 is arranged around the hole 711 of the upper surface of the base unit 710 in place of the fulcrum portion 512, the support 513 and the accommodation hole 514. One of the guide portions 712 and the other guide portion 712 hold the movable members 720 at different heights. In other words, an end of one movable member 720 and an end of the other movable member 720 are vertically superposed one on the other.

The pair of the movable members 720 is rectangular tabular members each having a triangular notch 721 at an end thereof.

The pair of the urging means 730 are coil springs interposed between the pair of the guide portions 712 and the pair of the movable members 720.

A method of using the multi-direction input apparatus having this configuration and the operation of each part thereof are explained below. First, the operating member 200 (refer to FIG. 12(*a*)) located at the original position C is activated to move diagonally upward in the drawing.

Then, the notch 721 of one movable member 720 in the direction of movement is pushed by the operating member 200 against the urging force of one urging means 730. As a result, the one movable member 720 moves in the direction away from the original position C and the other movable member 720 is also moved in the same direction by the urging force of the other urging means 730. In the process, the one urging means 730 is compressed between the one movable member 720 and the one guide portion 712, and the other urging means 730 is extended. As a result, the urging force of the one urging means 730 becomes larger than the urging force of the other urging means 730. In other words, the urging forces of the two urging means become unequal.

Upon activation and movement of the operating member 200, the first mobile unit 300*a* moves in X direction, and the first contactor 420*a* slides over the first resistor circuit 410*a*. At the same time the second mobile unit 300*b* moves in Y direction, and the second contactor 420*b* slides over the second resistor circuit 410*b*. The resistance value changed in accordance with the amount of movement of the first mobile unit 300*a* is output as a first output signal of the first signal output means 400*a*, and input to the electronic device used with the multi-direction input apparatus. At the same time, the resistance value changed in accordance with the amount of movement of the second mobile unit 300*b* is output as a second output signal of the second signal output means 400*b*, and input to the electronic device.

The electronic device detects the movement and the amount of movement of the operating member 200 in X direction based on the first output signal on the one hand, and detects the movement and the amount of movement of the operating member 200 in Y direction based on the second output signal on the other hand. The electronic device thus determines from this signal combination that the operating member 200 is activated right downward diagonally in the drawing.

After that, upon release of the operating member 200, the one movable member 720 is moved toward the original position C by the urging force of the one urging means 730. Then, the operating member body 210 of the operating member 200 is pushed by the notch 721 of the one movable member 720, and together with the other movable member 720, moved toward the original position C against the urging force of the other urging means 730. With the arrival of the operating member 200 at the original position C, the urging force of the one urging means 730 and the urging force of the other urging means 730 become equal to each other and act on each other. As a result, the operating member 200 is held by the notch 721 of the one movable member 720 and the notch 721 of the other movable member 720 and held at the original position C.

In the case where the operating member 200 is activated to move in X direction, as in the aforementioned case, the one movable member 720 moves in the direction away from the original position C, and the other movable member 720 also moves in the same direction. In the process, only the first mobile unit 300*a* moves and the first output signal is output from the first signal output means 400*a*. Upon activation of the operating member 200 to move in Y direction, on the other hand, the pair of the movable members 720 both move in the direction away from the original position C. In the process, only the second mobile unit 300*b* moves, and the second output signal is output from the second signal output means 400*b*. In this case, upon release of the operating member 200, the operating member 200 is pushed back by both of the pair of the movable members 720. Upon activation to move in other X-Y directions, the same process is followed as described above except that different parts of the movable members 720 are pushed by the operating member body 210 of the operating member 200 and push back the operating-member body 210.

In this multi-direction input apparatus, assume that the operating member body 210 of the operating member 200 returns to the original position C. The operating member body 210 is held and controlled by the pair of the movable members 720. As a result, unlike in the prior art, the operating member is not moved beyond the original position C, thereby making it possible to improve the accuracy of the restoration operation of the operating member 200.

The multi-direction input apparatus according to the first and second embodiments can be changed in design in any manner as long as the operating member can be activated to move in the direction away from a predetermined original position and the apparatus includes an origin restoration mechanism so configured that the operating member is urged by equal urging forces with the operating member therebetween thereby to hold the operating member at the original position, or as long as the operating member can be activated to move in the direction away from a predetermined original position, and the apparatus includes a force application means for applying a force to the operating member while at the same time being so configured that (1) in the case where the operating member is located at a predetermined point other than the original position, the resultant force exerted on the operating member is not zero and directed toward the original position, and (2) in the case where the operating member is located at the original position, on the other hand, the force of the force application means is applied to the operating member so that the resultant force is zero.

The link mechanism 520 of the origin restoration mechanism 500 may have any configuration including a plurality of movable members with the distal ends thereof arranged in opposed relation to each other with the operating member therebetween and coupled to each other in such a manner that the distal ends thereof are movable toward the original position.

The foregoing description refers to the case including four movable members 522, which may alternatively be at least two in number. As an example, three movable members 522 may be arranged at pitches of 120° and the operating member 200 is urged by the resultant force of substantially the same forces acting on each other from three directions thereby to hold the operating member at the original position C. Also, the movable members 522 are preferably identical in shape and arranged at pitches of 90° or predetermined intervals in such a manner that the urging forces of the urging means 530 can be equally applied to the operating member 200, to which configuration the invention is not limited. In the case where the shapes or intervals of the movable members 522 are varied, however, the shape and layout of each movable member 522 are required to be determined so that a plurality of urging forces of the urging means 530 may be exerted equally on the operating member 200 at the original position C through the movable members 522.

The base unit 510 of any shape can be employed as long as the link mechanism 520 can be included therein. Although the base unit 510 is described above as a member held between the upper case 110 and the lower case 120, the invention is not limited to that configuration. As an alternative, for example, the base unit 510 is mounted on the lower surface of the lower case 120, so that the rotary unit 521, the movable members 522 and the urging means 530 are arranged between the base unit 510 and the lower case 120. In this case, the first and second mobile units 300*a*, 300*b*, the first and second signal output means 400*a*, 400*b* and the built-in substrate 600 are interposed between the upper case 110 and the lower case 120. Incidentally, in this case, the hole 511 of the base unit 510 may be done without.

Also, the base unit 510 and the case body 100 can be arranged integrally with each other. For example, the rotary unit 521, the movable members 522 and the urging means 530 may be mounted on the ceiling plate 111 of the upper case 110 or the upper surface of the lower case 120.

With regard to the rotary unit 521 described above as an annular member, any configuration can be employed as long as the urging forces of the urging means 530 can be transmitted to the movable members and the distal end portions of the movable members can be moved toward the operating member. A polygonal tabular unit having an insertion port at the central portion thereof to insert the operating member 200 is an example.

The urging means 530, though described above as a coil spring compressed in accordance with the rotation of the rotary unit 521 to urge the rotary unit 521 in direction α, may be configured in any form to urge the rotary unit 521 in direction α. It is possible, for example, to use other springs, elastic members such as rubber compressed or tensioned or magnets repulsive to each other by the rotation of the rotary unit 521. All the urging means 530 may not be the same, and at least one urging means 530 can be used.

The urging means 530 described above are accommodated between the accommodation grooves 123 of the lower case 120 and the accommodation holes 514 of the base unit 510, to which configuration the invention is not limited. For example, the urging means 530 can be accommodated only in the accommodation holes 514 of the base unit 510, or in depressions formed on the rotary unit 521. In the case where depressions are formed on the rotary unit 521, protrusions to be inserted into the depressions are formed on the base unit 510 and each urging means 530 is arranged between an end surface of the depression and the protrusion. The protrusions may alternatively be formed on the upper case 110, etc.

The origin restoration mechanism 700 of any configuration can be used as long as it includes a plurality of movable members arranged in opposed relation to each other with the operating member therebetween on the surface of the base unit in such a manner as to be movable toward the original position and a plurality of urging means for urging the movable members toward the original position.

The base unit 710 of any shape can be employed as long as it can include the movable members 720 and the urging means 730. Also, the base unit 710, though described above as being held between the upper case 110 and the lower case 120, is not limited to such a configuration. As an alternative, for example, the based unit 710 is mounted on the lower surface of the lower case 120, and the movable members 720 and the urging means 730 are arranged between the base unit 710 and the lower case 120. In this case, the first and second mobile units 300*a*, 300*b*, the first and second signal output means 400*a*, 400*b* and the built-in board 600 are interposed between the upper case 110 and the lower case 120. In this case, the hole 711 is not required to be formed in the base unit 710.

Also, the base unit 710 can be formed integrally with the case body 100. As an example, the movable members 720 and the urging means 730 can be mounted on the ceiling plate 111 of the upper case 110 or the upper surface of the lower case 120.

As to the movable members 720, any shape can be employed as long as they can be brought into contact with the operating member 200. In other words, all the movable members 720 need not be in the same shape. In such a case, the urging forces of the urging means 730 are required to be appropriately selected in accordance with the shape of the movable members 720, so that the urging forces of a plurality of the urging means 730 are exerted equally on the operating member 200 located at the original position C through the movable members 720.

The movable members 720, though two in number as described above, may alternatively in any greater number. As shown in FIG. 13, for example, four movable members 720 can be arranged on the base unit 710 movably toward the original position C. Also in this case, adjacent movable members 720 are desirably arranged at different heights to keep the four movable members 720 out of contact with each other.

The urging means 730 of any configuration may be used other than the coil spring as described above, as long as the movable members 720 can be urged toward the original position C. For example, other springs, elastic members such as rubber or magnets repulsive to each other may be used. The urging means 730 are not required to be of the same type.

Embodiment 3

Next, a multi-direction input apparatus according to a third example embodiment of the invention is explained with reference to the drawings. FIG. 14 is a schematic plan view showing the origin restoration mechanism of the multi-direction input apparatus according to the third example embodiment of the invention.

The multi-direction input apparatus shown in FIG. 14 has a similar configuration to the multi-direction input apparatus according to the first embodiment except for a different configuration of the origin restoration mechanism 800. The points of difference are explained in detail below, while the identical or similar component parts are not described again. The origin restoration mechanism is designated by reference numeral 800, and other component members by the same reference numerals, respectively, as in the first embodiment.

The origin restoration mechanism 800 includes a base unit 810 arranged to cross the axis of the operating member 200, a rotary unit 821 (link) arranged rotatably around the axis of the operating member 200 on the surface of the base unit 810, four movable members 822 journaled rotatably with the rotation of the rotary unit 821 around the axis of the operating member 200 inside the rotary unit 821 on the surface of the base unit 810 and a pair of action force application means 830 for rotating the rotary unit 821 in a predetermined peripheral direction α.

The base unit 810 is the same as the base unit 510. Also, the rotary unit 821 is the same as the rotary unit 521. The movable members 822 are the same as the movable members 522. In the case where the operating member 200 is activated to move, however, the movable member 822 located in the direction of movement functions as a first movable member, and another movable member 822 in opposed relation to such a movable member 822 as a second movable member.

The action force application means 830 are first and second magnets 831, 832 repulsive to each other. The first magnet 831 is mounted in the accommodation hole 814 of the base unit 810. The second magnet 832 is mounted on the corresponding protrusion 821*d* of the rotary unit 821. Upon insertion of the protrusion 821*d* of the rotary unit 821 into the corresponding accommodation hole 814 of the base unit 810, the first and second magnets 831, 832 are opposed to each other. Specifically, the repulsive forces (i.e. the action forces) of the first and second magnets 831, 832 rotate the rotary unit 821 in direction α. This pair of the action force application means 830, by rotating the rotary unit 821, function as first and second action force applications means or first and second force application means, respectively (i.e. they double as each other in function).

A method of using the multi-direction input apparatus having this configuration and the operation of each part thereof are explained below. First, the operating member 200 (refer to FIG. 8) located at the original position C is activated to move diagonally upward in the drawing.

Then, the notch 822*c* at the distal end of a part of the movable members 822 (in this case, the movable member 822 at an upper right position in the drawing) located in the direction of movement is pushed by the operating member 200 against the repulsive force of a pair of the action force application means 830 through the rotary unit 821, whereby the particular movable member 822 is rotated. With this rotation, as shown in FIG. 8(*b*), the rear end portion of the particular movable member 822 is rotated, and the rotary unit 821 rotates in the direction opposite to α. With the rotation of the rotary unit 821, the rear end portions of the remaining movable members 822 are rotated, so that the remaining movable members 822 are rotated. The rotation of the rotary unit 821 causes the first and second magnets 831, 832 of the pair of the action force application means 830 to approach each other for an increased repulsive force.

In the process, the first mobile unit 300*a* moves in X direction, and the first contactor 420*a* slides over the first resistor circuit 410*a*. At the same time, the second mobile unit 300*b* moves in Y direction, and the second contactor 420*b* slides over the resistor circuit 410*b*. Then, the resistance value changed in accordance with the amount of movement of the first mobile unit 300*a* is output as a first output signal of the first signal output means 400*a*, and input to the electronic device used with the multi-direction input apparatus. At the same time, the resistance value changed in accordance with the amount of movement of the second mobile unit 300*b* is output as a second output signal of the second signal output means 400*b* and input to the particular electronic device.

The electronic device detects the movement and the amount of movement of the operating member 200 in X direction based on the first output signal on the one hand and the movement and the amount of movement of the operating member 200 in Y direction based on the second output signal on the other hand. The electronic device thus determines from the combination of the two signals that the operating member 200 is activated diagonally right downward in the drawing.

After that, upon release of the operating member 200, the rotary unit 821 is rotated in direction α by the repulsive force of the action force application means 830. As a result, all the movable members 822 are rotated, and the distal end portions of the movable members 822 are moved toward the original position C. In the process, the notch 822*c* at the distal end portion of a part of the movable members 822 pushes the operating member 200 back toward the original position C. Upon restoration of the operating member 200 to the original position C, the four movable members 822 come into contact with different portions of the outer surface of the operating member 200, respectively, and the operating member 200 is held by the particular movable members 822. At the same time, the action force (repulsive force) of the pair of the action force application means 830 is divided into four components through the rotary unit 821 and the four movable members 822, which four components are equally exerted on and act on the operating member 200. As a result, the operating member 200 is held at the original position C.

In the case where the operating member 200 is activated to move in X direction, only the first mobile unit 300*a* is moved, and the first output signal is output from the first signal output means 400*a*. Upon activation of the operating member 200 to move in Y direction, on the other hand, only the second mobile unit 300*b* is moved and the second output signal is output from the second signal output means 400*b*. In these cases, the operation is similar to the one described above except that a different part of the movable member 822 is pushed by the operating member body 210 of the operating member 200 or pushes back the operating member body 210. This is also the case with the activation of the operating member 200 to move in other directions.

In this multi-direction input apparatus, the operating member 200, upon restoration to the original position C, is held and controlled by the four movable members 822. As a result, unlike in the prior art, the operating member is not moved beyond the original position C, thereby improving the accuracy with which the operating member 200 is restored. In addition, upon movement of the operating member 200 to the maximum movable position, the notch 822*c* of the movable member 822 assumes the same arcuate form, in plan view, as the edge portion of the hole 811 of the base unit 810. Therefore, with the arrival of the operating member 200 at the maximum movable position, the load is exerted on the operating member body 210 of the operating member 200 substantially equally in all the operative directions. As a result, the rotational operation of the operating member 200 becomes smooth for an improved operation feeling.

Embodiment 4

Next, the multi-direction input apparatus according to a fourth example embodiment of the invention is explained with reference to the drawings. FIG. 15 is a schematic plan view showing the origin restoration mechanism of a multi-direction input apparatus according to the fourth example embodiment of the invention, in which (a) is a diagram showing the state in which the operating member is located at the original position, and (b) a diagram showing the state in which the operating member is activated to move in diagonally upper direction in the drawing from the original position.

The multi-direction input apparatus shown in FIG. 15 has the same configuration as the multi-direction input apparatus according to the second embodiment except that the configuration of the origin restoration mechanism 900 is different. The points of this difference are explained in detail below, while similar or identical component parts are not described. Incidentally, the origin restoration mechanism is designated by reference numeral 900, and the remaining component members are designated by the same reference numerals, respectively, as those in the first embodiment.

The origin restoration mechanism 900 includes a base unit 910 arranged in such a manner as to cross the axis of the operating member 200, a pair of movable members 920 arranged in opposed relation to each other with the operating member 200 therebetween on the surface of the base unit 910 and movable toward the original position C, and a pair of action force application means 930 for urging the pair of the movable members-920 toward the original position C.

The base unit 910 is the same as the base unit 710. The movable members 920 are also the same as the movable members 720. When the operating member 200 is activated to move, however, one movable member 920 located in the operative direction of movement functions as a first movable member and the other movable member 920 as a second movable member.

The action force application means 930 are formed of first and second magnets 931, 932 repulsive to each other. Each first magnet 931 is mounted on the corresponding movable member 920. Each second magnet 932, on the other hand, is mounted on the corresponding guide portion 912 of the base unit 910 in opposed relation to the magnet 931. Specifically, the movable members 920 are moved toward the original position C by the repulsive forces of the first and second magnets 931, 932. This pair of the action force application means 930 are such that upon activation of the operating member 200 to move, one action force application means 930 located in the operative direction functions as a first action force application means or a first force application means, while the other action force application means 930 functions as a second action force application means or a second force application means (i.e. both double as each other).

A method of using the multi-direction input apparatus having this configuration and the operation of each part are described below. First, the operating member 200 (refer to FIG. 15(*a*)) located at the original position C is activated to move diagonally upward in the drawing.

Then, the notch 921 of the one movable member 920 in the direction of movement is pushed by the operating member 200 against the repulsive force of the one action force application means 930. As a result, the one movable member 920 moves in the direction away from the original position C together with the operating member 200. The other movable member 920, on the other hand, moves in the same direction due to the repulsive force of the other action force application means 930. Incidentally, as shown in FIG. 15(*b*), the first and second magnets 931, 932 of the one action force application means 930 approach each other and the repulsive force is increased. The first and second magnets 931, 932 of the other action force application means 930, on the other hand, come away from each other and the repulsive force is decreased.

In the process, the first mobile unit 300*a* moves in X direction, and the first contactor 420*a* slides over the first resistor circuit 410*a*. At the same time, the second mobile unit 300*b* moves in Y direction, and the second contactor 420*b* slides over the second resistor circuit 410*b*. Then, the resistance value changed with the amount of movement of the first mobile unit 300*a* is output as a first output signal of the first signal output means 400*a* and input to the electronic device used with the multi-direction input apparatus. At the same time, the resistance value changed with the amount of movement of the second mobile unit 300*b* is output as a second output signal of the second signal output means 400*b* and input to the electronic device.

The electronic device detects the movement and the amount of movement of the operating member 200 in X direction based on the first output signal on the one hand and the movement and the amount of movement of the operating member 200 in Y direction based on the second output signal on the other hand. The electronic device thus determines from this signal combination that the operating member 200 is activated diagonally right downward in the drawing.

After that, upon release of the operating member 200, the one movable member 920 is moved toward the original position C by the repulsive force of the one action force application means 930. Then, the operating member 200 is pushed by the notch 921 of the one movable member 920, and moved toward the original position C against the repulsive force of the other action force application means 930 together with the other movable member 920. Once the operating member 200 comes to be located at the original position C, the repulsive force of the one action force application means 930 and the repulsive force of the other action force application means 930 are equalized with each other and act on each other. As a result, the operating member 200 is sandwiched between the notch 921 of the one movable member 920 and the notch 921 of the other movable member 920 and held at the original position C.

Upon activation of the operating member 200 to move in X direction, as in the aforementioned case, the one movable member 920 moves in the direction away from the original position C, and the other movable member 920 also moves in the same direction. In the process, only the first mobile unit 300*a* moves, and the first output signal is output from the first signal output means 400*a*. Upon activation of the operating member 200 to move in Y direction, on the other hand, the pair of the movable members 920 both move in the directions away from the original position C. At the same time, only the second mobile unit 300*b* moves and the second output signal is output from the second signal output means 400*b*. In this case, the operating member 200, if released, is pushed back by the pair of the movable members 920 (in this case, the pair of the movable members 920 each function as both the first and second movable members and the pair of the action force application means 930 each function as both the first and second action force application means). Upon activation to move in other X-Y directions, the operation is performed in the same manner as the one described above, except that a different part of the movable members 920 is pushed by the operating member 200 and pushes back the operating member 200.

With this multi-direction input apparatus, the operating member body 210 of the operating member 200, upon restoration to the original position C, is held and controlled by the pair of the movable members 920. Unlike in the prior art, therefore, the operating member is not moved beyond the original position C and the accuracy of the restoration operation of the operating member 200 is improved.

The multi-direction input apparatus according to the third and fourth embodiments can be changed in design any way as long as the operating member can be activated to move in the direction away from a predetermined original position and the apparatus includes an origin restoration mechanism having the first action force application means for applying the action force in such a direction that the operating member activated moves toward the original position and the second action force application means for applying the action force in the direction opposite to the direction of restoration to the operating member restored to the original position by the action force of the first action force application means, or as long as the operating member can be activated to move in the direction away from a predetermined original position and the apparatus includes an origin restoration mechanism having the first force application means for applying the force to restore the operating member located at other than the original position to the original position by the activation for movement and the second force application means for applying the force to prevent the operating member restored by the first force application means to the original position from exceeding the original position.

The action force application means 830, 930 (force application means), though constituted of the first and second magnets 831, 832, 931, 932, may alternatively be of any type as long as the action force can be applied to the operating member. A spring or the like elastic member as described in the first and second embodiments is a possible example.

Also, in spite of the foregoing description to the effect that the action force is applied by the action force application means 830, 930 to the operating member 200 through the rotary unit 821, the movable members 822 or the movable members 920, the invention is not limited to this configuration. For example, the first magnet of the action force application means may be mounted on the operating member while the second magnet may be arranged in opposed relation to the first magnet in the direction of activation and movement of the operating member.

Further, in spite of the foregoing explanation that the action force application means 830, 930 function as both the first and second action force application means or both the first and second force application means, a second action force application means or a second force application means, as the case may be, may be provided which is dedicated to the control of the operating member by applying the action force opposite to the direction of restoration to the original position to which the operating member is returned. In the case where the action force of the second action force application means or the second force application means is applied through a movable member, the particular movable member constitutes a second movable member dedicated to the control of the operating member.

The base units 810, 910 can be changed in design similarly to the base units 510, 710.

The movable members 822, 920 can be changed in design in the manner similar to the movable members 522, 720. Also, in the case where an elastic material is used for the action force application means 830, 930 (force application means), the movable members 822, 920 are configured of a material higher in rigidity than the particular elastic material. In the case where the movable member is formed of a material higher in rigidity than the elastic material in this way, it is possible to transmit the forces of the action force application means 830, 930 (force application means) accurately to the operating member, thereby advantageously improving the restoration accuracy of the operating member.

As an alternative to the link formed of the rotary unit 821 described above, a link of any type which can couple the movable members 822 in operatively interlocked relation to each other can be employed.

In the embodiments described above, the case body 100 includes the upper case 110, the lower case 120 and the mounting member 130. Nevertheless, the case body 100 of any shape can be used as long as the functions as a case can be fulfilled.

Also, the operating member 200 of any shape which can be operable may be used. The provision of the disk 220 is arbitrary.

The first and second signal output means 400*a*, 400*b* of any type which can output signals in accordance with the movement of the operating member 200 can be employed. For example, a metal plate is mounted at the lower end of the operating member 200 and a magnet on the vertical line passing through the original position C on the bottom surface of the case, while a plurality of electromagnetic conversion elements are arranged along the peripheral edge of the magnet, so that the change in magnetic field due to the passage of the metal plate is converted into a signal by the electromagnetic conversion elements, and based on this signal, the movement of the operating member can be detected. In this case, the first and second mobile units 300*a*, 300*b* are done without.

In spite of the foregoing description of the input apparatus as a multi-direction input apparatus, the invention is of course applicable to various input apparatuses in which the operating member is moved in at least one direction away from a predetermined original position. In this case, at least one each of the mobile unit and the signal output means are provided.

The original position C, which is located at the central portion of the opening 111*a* of the case 100 as described above, may alternatively be set arbitrarily or, for example, located at the center of the input apparatus.

The invention claimed is:

1. A combination of an origin restoration mechanism and an operating member, the combination comprising:

the operating member operable to move in a direction away from a predetermined original position; and the origin restoration mechanism including:

a base unit arranged in such a manner as to cross an axis of the operating member, the base unit having a first surface;

a link mechanism provided on the first surface of the base unit and having a plurality of movable members, the movable members having distal end portions arranged in opposed relation to each other facing the operating member, the movable members being coupled such that the distal end portions thereof are movable toward the original position; and an urging device for moving the distal end portions of the plurality of the movable members toward the original position, wherein a plurality of urging forces of the urging device exerted through the plurality of movable members are exerted equally on the operating member and act on each other due to abutment of the distal end portions of all the movable members against the operating member located at the original position, wherein the link mechanism includes:

an annular rotary unit provided on the first surface of the base unit rotatably around the axis of the operating member and said plurality of movable members further comprising rear end portions opposite the distal end portions, and intermediate portions provided between the distal end portions and the rear end portions, the rear end portions being rotatably coupled to the rotary unit and the intermediate portions being journaled rotatably in accordance with the rotation of the rotary unit around the axis of the operating member inside the rotary unit on the first surface of the base unit, and wherein the urging device urges the rotary unit in a predetermined peripheral direction, and the urging forces of the urging device cause respective transverse end surfaces of the distal end portions of the movable members to come into contact with different portions of an outer surface of the operating member located at the original position.

2. The combination of the origin restoration mechanism and the operating member as set forth in claim 1, wherein the base unit includes a circular hole through which the operating member is inserted, and wherein an arcuate notch is formed on an end surface of the distal end portion of each movable member of the link mechanism, the notch assuming the same arcuate shape as an edge portion of the hole of the base unit in the case where the operating member moves to a maximum movable position.

3. A multi-direction input apparatus comprising:

the combination of the origin restoration mechanism and the operating member as described in claim 1;

a case body having a ceiling plate with an opening, the operating member being operable to move in X-Y directions from the original position corresponding to a center portion of the opening;

first and second mobile units movable in X and Y directions in accordance with the movement of the operating member; and first and second signal output devices for outputting signals in accordance with the movement of the first and second mobile units.

4. A multi-direction input apparatus as set forth in claim 3, wherein the urging device is an elastic member, wherein the rotary unit includes a protrusion urged by the urging device, wherein the base unit includes a first accommodating portion into which the protrusion of the rotary unit is inserted and which accommodates the urging device, and wherein a portion of the case body opposed to the base unit has a second accommodating portion for accommodating the urging device with the first accommodating portion.

5. A multi-direction apparatus as set forth in claim 4, wherein the rotary unit and the movable members of the link mechanism are held rotatably between the base unit and the case body.

6. The combination of the origin restoration mechanism and the operating member as set forth in claim 1, wherein the operating member includes:

an operating member body; and a disk portion being provided integrally at a central portion of the operating member body and extending perpendicularly to the operating member body, the base unit further has a second surface opposite to the first surface, and a hole passing through from the first surface to the second surface, and the operating member body passes through the hole of the base unit and the disk portion is movable along the second surface of the base unit.

* * * * *